US009936540B1

(12) United States Patent
Myers et al.

(10) Patent No.: US 9,936,540 B1
(45) Date of Patent: Apr. 3, 2018

(54) SNAP FIT ACCESSORY FOR HEAT TRACE CABLE

(71) Applicant: Chromalox, Inc., Pittsburgh, PA (US)

(72) Inventors: Christopher D. Myers, Murfreesboro, TN (US); Craig Calloway, Murfreesboro, TN (US); Russell J. Schweizer, Crystal Lake, IL (US)

(73) Assignee: CHROMALOX, INC., Pittsburgh, PA (US)

( * ) Notice: Subject to any disclaimer, the term of this patent is extended or adjusted under 35 U.S.C. 154(b) by 0 days.

(21) Appl. No.: 15/635,467

(22) Filed: Jun. 28, 2017

(51) Int. Cl.

| | |
|---|---|
| ***H01R 4/38*** | (2006.01) |
| ***H05B 3/56*** | (2006.01) |
| ***H01R 4/22*** | (2006.01) |
| ***H01R 13/518*** | (2006.01) |
| ***H01R 13/60*** | (2006.01) |
| ***H01R 13/42*** | (2006.01) |
| ***H01R 13/627*** | (2006.01) |
| ***H01R 4/24*** | (2018.01) |
| ***H01R 13/11*** | (2006.01) |
| ***H01R 13/52*** | (2006.01) |

(Continued)

(52) U.S. Cl.
CPC ..... *H05B 3/56* (2013.01); *H01R 4/22* (2013.01); *H01R 4/2433* (2013.01); *H01R 13/113* (2013.01); *H01R 13/42* (2013.01); *H01R 13/518* (2013.01); *H01R 13/5219* (2013.01); *H01R 13/60* (2013.01); *H01R 13/622* (2013.01); *H01R 13/6272* (2013.01); *H01R 43/20* (2013.01); *H01R 43/26* (2013.01); *H05B 3/06* (2013.01)

(58) Field of Classification Search
CPC ..... H01R 13/5219; H01R 13/622
USPC ..... 439/320, 321
See application file for complete search history.

(56) References Cited

U.S. PATENT DOCUMENTS 3,408,616 A * 10/1968 Greenbaum ..... H01R 4/2412 439/410
4,360,242 A * 11/1982 Poliak ..... H01R 4/2412 439/410

(Continued)

*Primary Examiner* — Phuong Dinh
(74) *Attorney, Agent, or Firm* — K&L Gates LLP

(57) ABSTRACT

A kit or assembly comprises a plug body, a housing, and an end cap. The plug body comprises an opening sized to receive a cable, and first and second members. The first member is pivotably connected to the plug at a first position and comprises a first blade extending inwardly relative to the plug body and a first electrical contact. The second member is pivotably connected to the plug at a second position and comprises a second blade extending inwardly relative to the plug body and a second electrical contact, where the second position is longitudinally offset from the first position. The housing comprises a socket to receive the first electrical contact and the second electrical contact and the end cap is threadably engageable with the housing, with the end cap comprising an interior sized to receive the plug body. Engaging the end cap with the housing causes the first member and the second member to contact the housing and pivot inwardly such that the first blade and the second blade pierce a jacket of the cable positioned within the plug body to contact the first and second electrical wires of the cable respectively, establishing an electrical path from the first and second wires of the cable through the first electrical contact and the second electrical contact to the socket.

20 Claims, 27 Drawing Sheets

(51) Int. Cl.

| | |
|---|---|
| ***H01R 43/20*** | (2006.01) |
| ***H01R 43/26*** | (2006.01) |
| ***H01R 13/622*** | (2006.01) |
| ***H05B 3/06*** | (2006.01) |

(56) References Cited

U.S. PATENT DOCUMENTS

| | | | | |
|---|---|---|---|---|
| 4,696,527 | A | 9/1987 | Ding et al. | |
| 4,883,945 | A | 11/1989 | Bautista | |
| 5,190,469 | A * | 3/1993 | Mui | H01R 4/24 439/410 |
| 5,341,684 | A | 8/1994 | Adams et al. | |
| 5,692,918 | A | 12/1997 | Hill | |
| 5,756,972 | A | 5/1998 | Vranicar et al. | |
| 7,140,905 | B2 * | 11/2006 | Castaldo | H01R 13/5833 439/395 |
| 7,878,868 | B2 | 2/2011 | Mech et al. | |
| 8,039,750 | B2 | 10/2011 | Magnusson | |
| 8,449,326 | B2 | 5/2013 | Holland et al. | |
| 8,968,025 | B2 | 3/2015 | Shaw | |
| 9,577,355 | B1 | 2/2017 | Shaw | |
| 2017/0162986 | A1 | 6/2017 | Davidson | |

* cited by examiner

SNAP FIT ACCESSORY FOR HEAT TRACE CABLE

BACKGROUND

Heat trace systems are commonly used in industrial and commercial settings to maintain or raise the temperature of pipes through an electrical heating element or heat trace that is in physical contact with the pipe to be heated. In such settings, heat trace cables need to be connected to power supplies or other heat trace cables. However, terminating a heat trace cable to supplied power wiring or another heat trace cable currently presents multiple difficulties. Current devices and methods for terminating heat trace cables are prone to failure, are unreliable, suffer from water ingress, and take a substantial amount of effort to complete. Additionally, there are simply many opportunities for errors when terminating heat trace cables because of the significant number of steps involved in the process, from removing the outer jacket and braid of the cable to properly interconnecting the heat trace cable wiring to the other electrical wiring.

SUMMARY

In one general aspect, the present disclosure is directed to an assembly or kit for connecting a cable, particularly a heat trace cable, to a corresponding device, particularly a cable or a power source. In various embodiments, the cable connector assembly comprises an end cap and a plug assembly, including a plug body, which is connectable to an end of a cable. The plug body comprises an opening sized to receive a cable, a first member pivotably connected to the plug at a first position, and a second member pivotably connected to the plug at a second position. Each pivotable member further comprises a blade extending inwardly relative to the plug body and an electrical contact. In various embodiments, the second position is longitudinally offset from the first position. The cable connector assembly further comprises a housing, which includes a socket to receive the first electrical contact and the second electrical contact, and an end cap threadably engageable with the housing. The end cap can be sized to receive the plug body.

Once the end of the cable is threaded through the end cap and connected to the plug body, the plug body can be placed within the end cap and the end cap can then be engaged with the corresponding connection on the housing. When the plug body is inserted into the housing, the electrical contacts engage the corresponding sockets positioned within the housing. When the end cap is engaged with the housing, the first member and the second member of the plug body are pivoted inwardly by contact with the housing. When the members pivot inwardly, the blades pierce the jacket of the cable positioned within the plug body and contact the electrical wires of the cable, establishing an electrical path from the wires of the cable through the electrical contacts of the plug body to the socket. Various other embodiments can include additional electrical adapters, such as a power plug assembly.

The described kit or assembly provides a self-contained unit for interchangeably connecting cables to other electrical wiring that requires no or few additional tools. In various embodiments, the assembly can additionally form a watertight enclosure when assembled, protecting the electrical components therein from damage. These and other benefits of the present invention will be apparent from the description that follows.

BRIEF DESCRIPTION OF THE DRAWINGS

Various embodiments of the present invention are described herein by way of example in conjunction with the following figures, wherein.

DETAILED DESCRIPTION

The present disclosure is directed generally to assemblies and kits for connecting electrical wiring or cables, e.g., heat trace cables, to power cables or power sources, other electrical cables, and any other such devices. The assemblies and kits are generally described herein in the context of heat trace cables, but the assemblies and kits are not so limited and, accordingly, they could be used to connect other types of electrical cables or wires. The cable connector assembly includes a plug assembly that is attachable to an end of a cable and a housing including a socket assembly that is configured to receive the plug assembly. The cable connector assembly can be provided as a kit designed for retrofitting a cable or can be manufactured as part of a cable. These embodiments will be discussed interchangeably. Various embodiments of the cable connector assembly can include a power plug assembly for connecting the system to a power source or one or more additional plug assemblies for connecting the system to additional cables or other electrical wiring. Furthermore, the cable connector assembly is configured to entirely enclose the electrical components of the system within the housing when all plug assemblies, power plug assemblies, and any other electrical adapters are secured to the housing. Fully enclosing the electrical components protects them from moisture and provides improved safety compared to conventional methods of terminating such electrical cables. The cable connector assembly thus serves as an adaptable or configurable connection system for terminating or joining a cable to another cable, a power source, or other electrical wiring.

Figure 1:
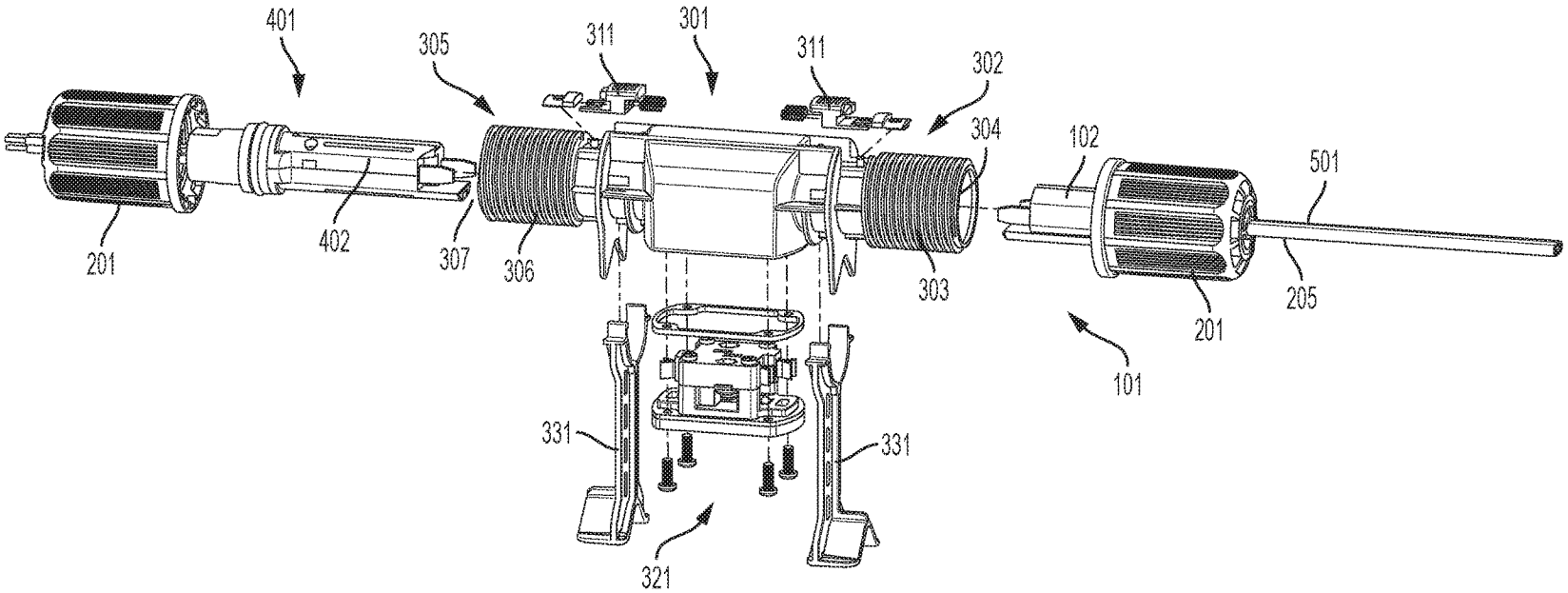
FIG. 1 depicts an exploded view of a cable connector assembly according to various embodiments of the present disclosure.
Figure 2:
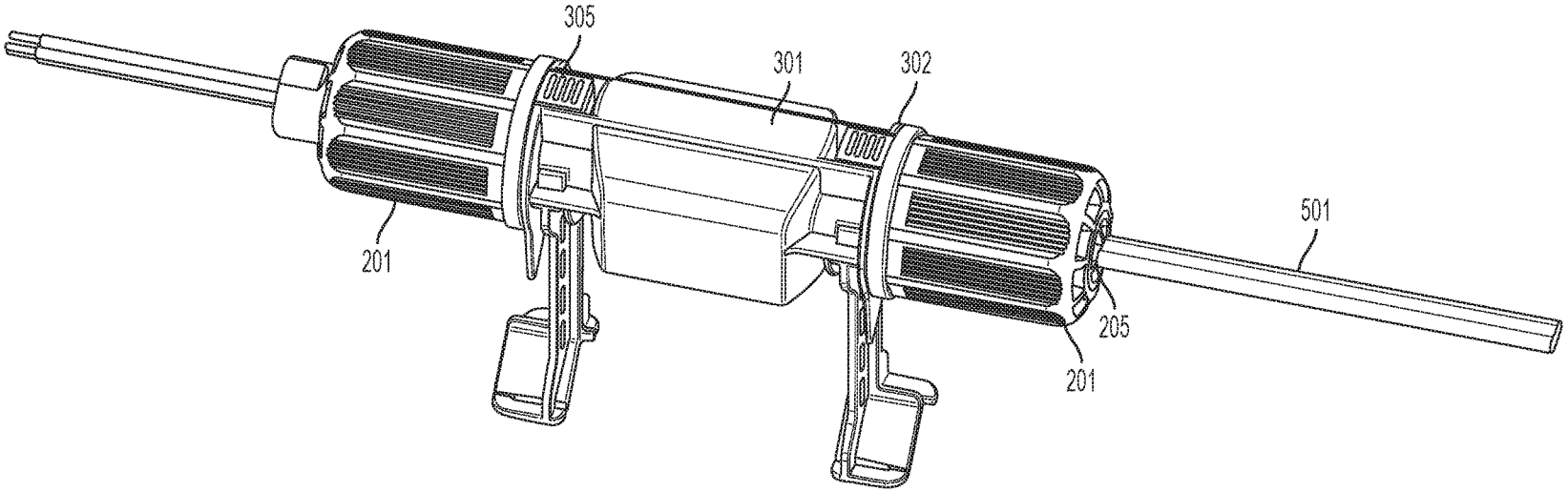
FIG. 2 depicts a perspective view of a cable connector assembly according to various embodiments of the present disclosure.

FIGS. 1-2 show an exploded view and a perspective view, respectively, of a cable connector assembly according to various embodiments of the present disclosure. The depicted embodiment of the cable connector assembly comprises a plug assembly 101 that receives a cable 501, a housing 301, and an end cap 201 to secure the plug assembly 101 to the housing 301. In such an embodiment, the cable 510 comprises a heat trace cable that includes two buss wires surrounded by a conductive matrix (which is preferable polymeric). The conductive matrix in turn may be surrounded a jacket, which may be surrounded by a metallic (e.g., tinned copper) braid and an overjacket over the braid. The buss wires carry electrical current and the heat from the heat trace can heat a pipe or other vessel that it contacts to offset any losses in the pipe/vessel temperature. More details regarding such an exemplary heat trace cable can be found in U.S. Pat. No. 9,429,455, which is incorporated herein by reference in its entirety.

Figure 12:
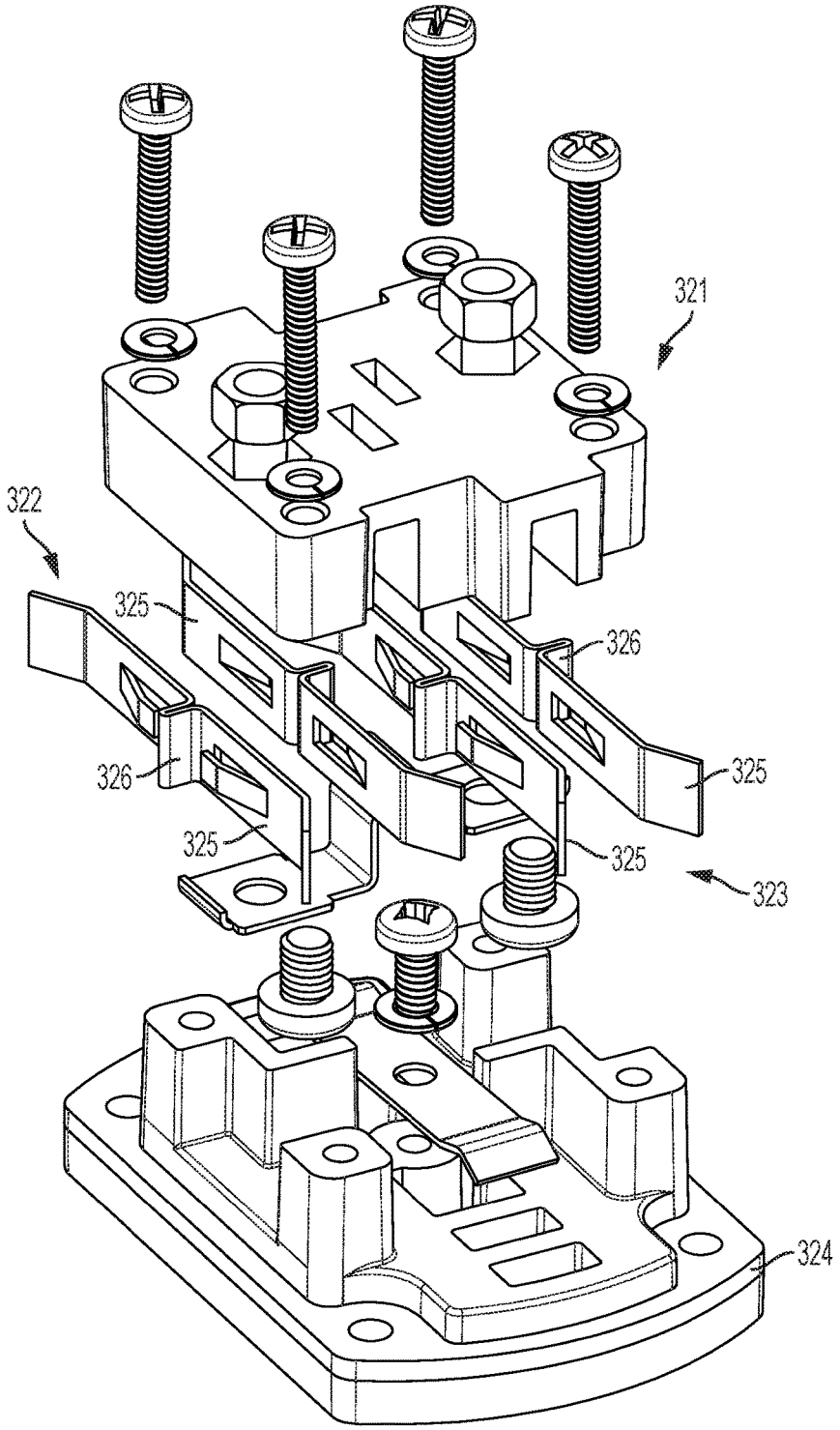
FIG. 12 depicts an exploded view of a socket assembly according to various embodiments of the present disclosure.
Figure 13:
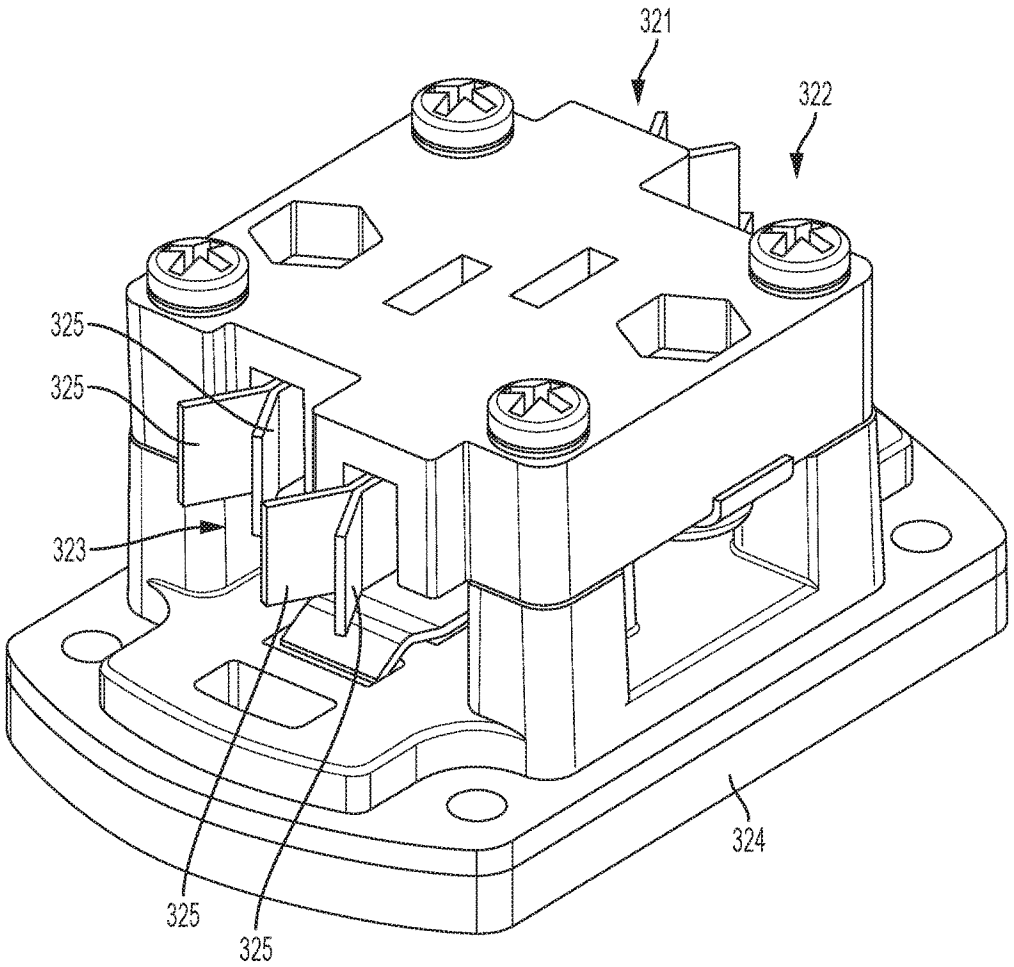
FIG. 13 depicts a perspective view of a socket assembly according to various embodiments of the present disclosure.

The illustrative cable connector assembly further comprises a socket assembly 321, which is enclosed by the housing 301. As shown in FIGS. 12 and 13, for example, the socket assembly 321 can comprise two or more sockets 322, 323 that are electrically connected together. In an illustrative embodiment, the first socket 322 is configured to receive the plug assembly 101 and the second socket 323 is configured to receive a power cable or another such electrical cable via a power plug assembly 401. In various embodiments the sockets 322, 323 can be configured to interchangeably receive the plug assembly 101, the power plug assembly 401, and any other electrical plugs.

According to various embodiments, the connector assembly is utilized by staging the end cap 201 onto the cable 501. In some embodiments, the end cap 201 is staged onto the cable 501 by threading the cable 501 through an aperture 205 in the end cap 201 into the plug body 102. In one embodiment, the aperture 205 of the end cap 201 and the aperture 111 of the plug body 102 through which the cable 501 is threaded are equal to a close tolerance of the dimensions of the cable 501 in order to limit the clearance therebetween. The plug body 102 and the end cap 201 are sized and shaped such that the plug body 102 can be received within the interior of the end cap 201. The end cap 201 can then be engaged with a corresponding portion of the housing 301, situating the plug assembly 101 between the end cap 201 and the housing 301, such that the plug assembly 101 extends at least partially in the housing 301 through a channel 304. In an illustrative embodiment, the end cap 201 is securable to the housing 301 via a threaded connection.

Engaging the end cap 201 with the housing 301 causes the plug assembly 101 to advance into the interior of the housing 301, which in turn causes two events to occur in various embodiments. First, the pivotable contacts 103 make contact with sidewalls of the channel 304, which causes the pivotable contacts 103 to pivot inwardly and pierce the jacket of the cable 501. When the pivotable contacts 103 pierce the jacket of the cable 501, they separately make contact with each of the bus wires enclosed within the cable 501, without damaging the bus wires, and thereby provide a current path between each of the pivotable contacts 103 and the bus wires of the cable 501. Second, the pins 133 of the plug body 102 are received by a first socket 322 within the housing 301. The dual action of (i) the pivotable contacts 103 making contact with the bus wires of the cable 501 and (ii) the pins 133 being received by the first socket 322 creates an electrical pathway from the cable 501 to the first socket 322. When secured together as depicted in FIG. 2, the end caps 201 and the housing 301 enclose the socket assembly 321, the power plug assembly 101, and the adapter or electrical wiring to which the cable 501 is being joined. In some embodiments, the end caps 201 and the housing 301 form a watertight enclosure.

In an illustrative embodiment, the cable connector assembly can be provided as a cable connection system that is pre-installed or integral to the cable system. In another illustrative embodiment, the cable connector assembly can be provided as a kit used to join an existing heat trace cable 501 (or other type of electrical cable or wire) to one or more other heat trace cables or a power source. The plug assembly 101 can be configured to be retrofitted to the connection end of a heat trace cable 501 utilizing a process that requires few or no additional tools outside of the kit.

Figure 3:
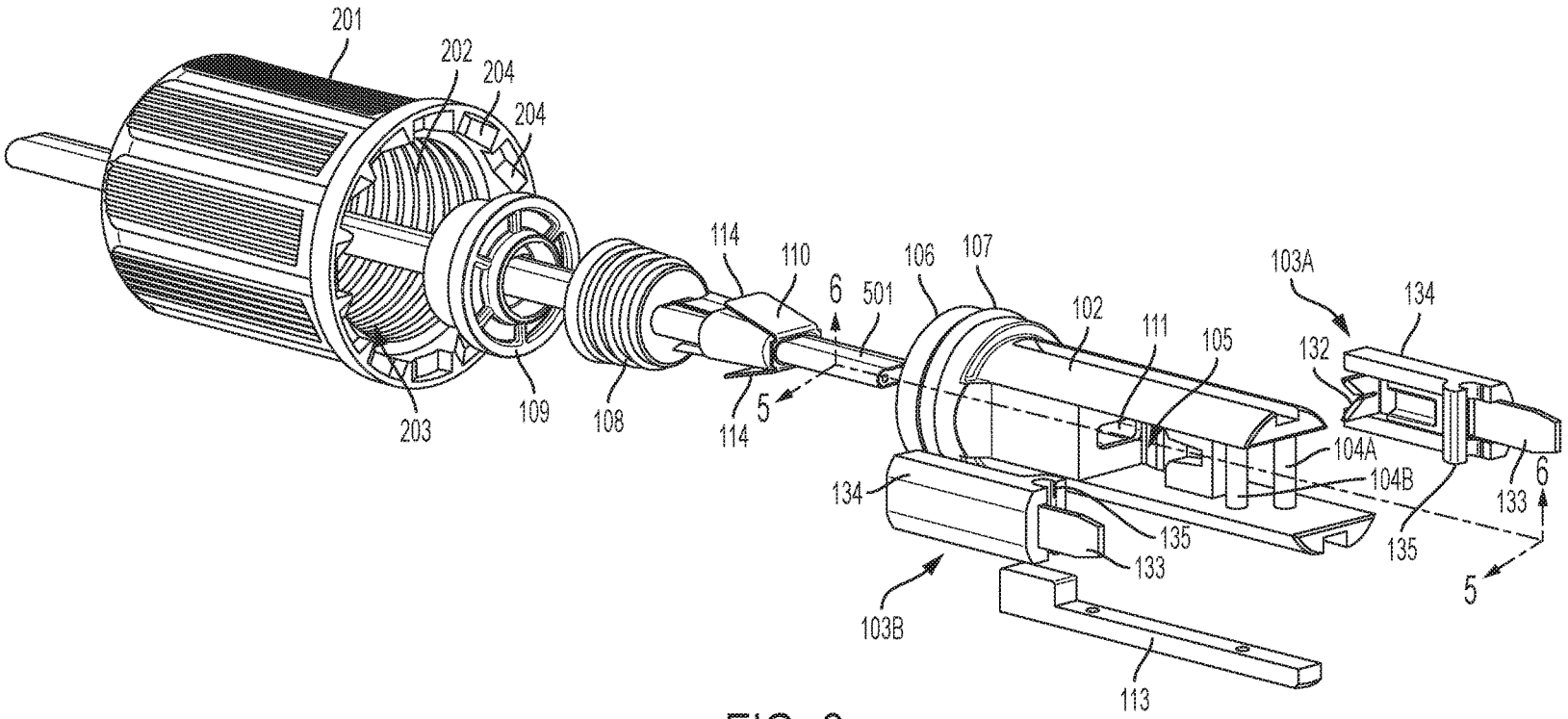
FIG. 3 depicts an exploded view of an end cap and a plug assembly according to various embodiments of the present disclosure.
Figure 4:
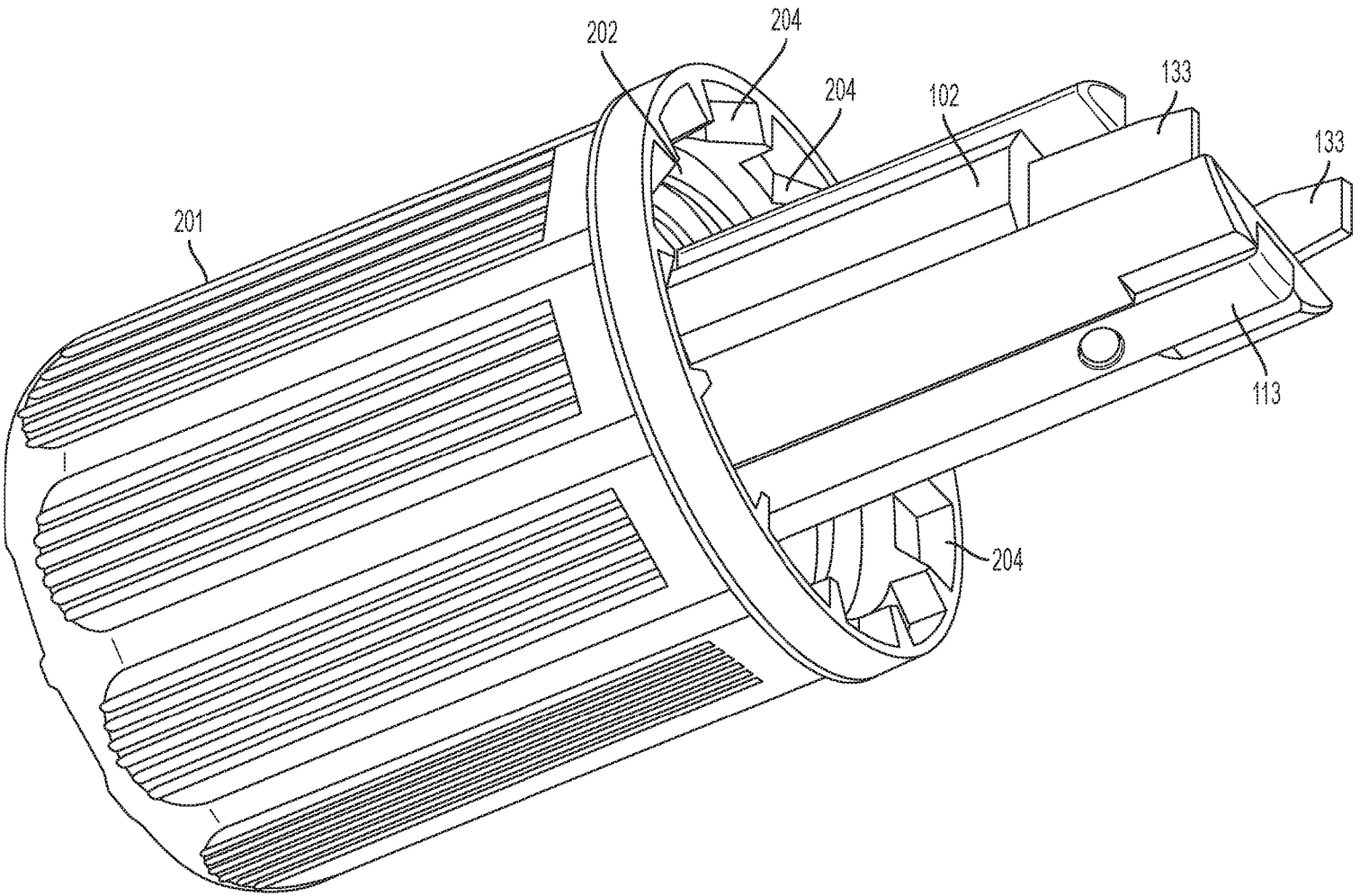
FIG. 4 depicts a perspective view of an end cap and a plug assembly according to various embodiments of the present disclosure.
Figure 5:
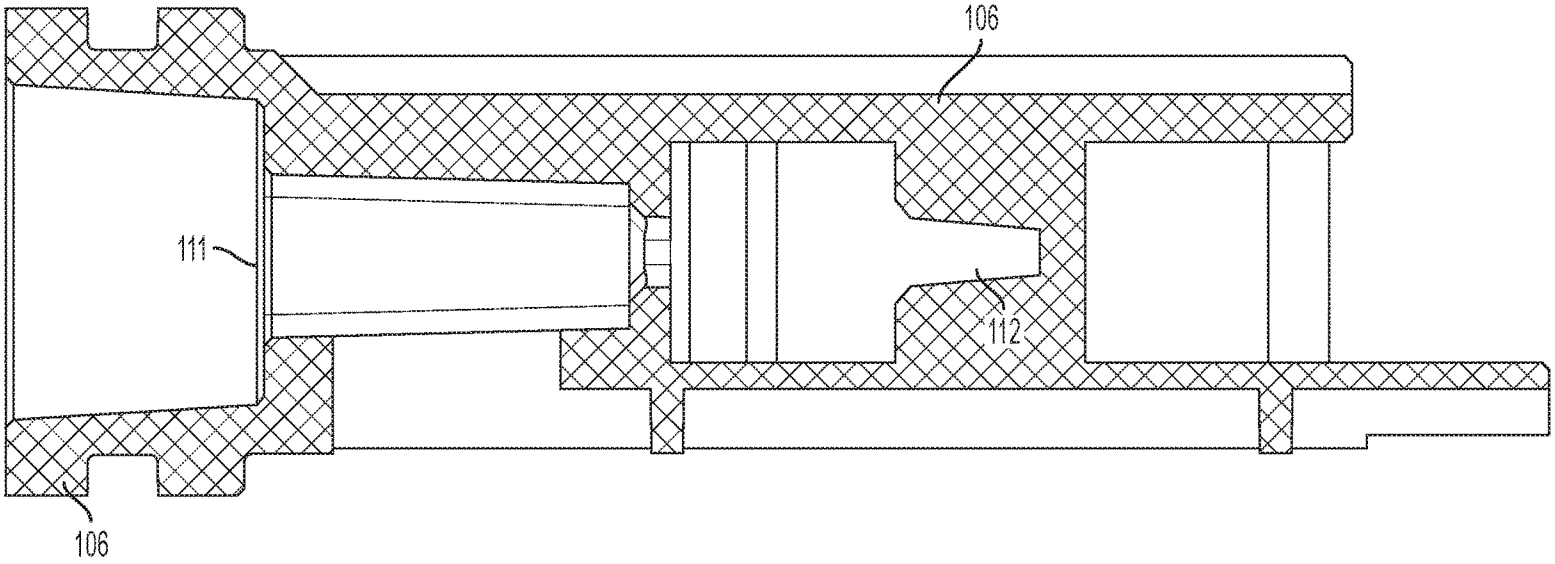
FIG. 5 depicts a sectional view of a plug body along line 5-5 according to various embodiments of the present disclosure.
Figure 6:
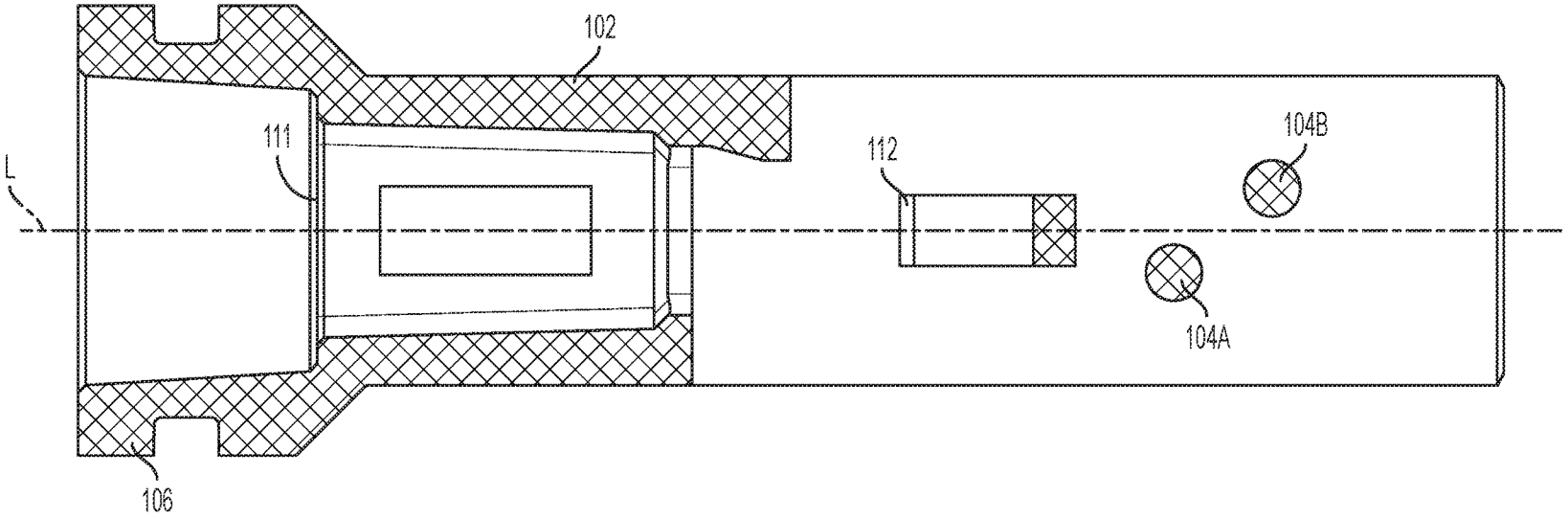
FIG. 6 depicts a sectional view of a plug body along line 6-6 according to various embodiments of the present disclosure.

FIGS. 3-6 show various views of an end cap and a plug assembly, and sectional views of a plug body according to various embodiments of the present disclosure. The plug body 102 comprises an aperture 111 sized and shaped to receive a cable 501 therethrough and an interior 105 into which an end of the cable 501 can extend. The interior 105 of the plug body 102 further comprises a notch 112 that is configured to receive the connection end of the cable 501. In one embodiment, the notch 112 is dimensioned to a close tolerance of the dimensions of an end of the cable 501 such that the end of the cable 501 is held in the notch 112 via a frictional fit. The plug assembly 101 further comprises a first pivotable contact 103A and a second pivotable contact 103B, which are movably attached to the plug body 102. Each pivotable contact 103A, 103B comprises a housing 134 at least partially encasing a conductive member 131. The conductive member 131 comprises a first end that terminates in a blade 132 and an opposing second end that terminates in a pin 133. In one embodiment, the blade 132 is V-shaped as shown in FIG. 3 (and FIGS. 7 and 9).

The pivotable contacts 103A, 103B are movably connected to the plug body 102 such that the they can transition between a first position wherein the blades 132 of the pivotable contacts 103A, 103B extend into the interior 105 of the plug body 102 to make contact with a cable 501 therein and a second position wherein the blades 132 do not make contact with a cable therein. In an illustrative example, the first and second pivotable contacts 103A, 103B each comprise a hook 135 that is pivotably connected to a corresponding post 104A, 104B disposed on the plug body 102. In one embodiment, the first pivotable contact 103A and second pivotable contact 103B are attached to the plug body 102 such that they are offset from each other relative to the longitudinal axis L-L of the plug body 102. In an illustrative embodiment, the plug body 102 comprises a first post 104A to which the first pivotable contact 103A is connected and a second post 104B to which the second pivotable contact 103B is connected. The second post 104B is positioned distal relative to the first post 104A, which in turn places the first pivotable contact 103A and the second pivotable contact 103B in an offset relationship relative to each other. In this embodiment, the first and second pivotable contacts 103A, 103B are equal or substantially equal in length. Since the first and second pivotable contacts 103A, 103B are longitudinally offset relative to each other and they are substantially equal in length, the blades 132 are therefore likewise longitudinally offset from each other when the blades 132 make contact with and pierce the cable 501. The blades 132 being offset relative to each other reduces the amount of force required by the pivotable contacts 103A, 103B to pierce the cable 501 and self-centers the cable 501 by cupping each of the bus wires within the notch 137 of each blade 132 to ensure that the connection between the pivotable contacts 103A, 103B and the cable 501 is consistent with each use. In an alternative embodiment, the blades 132 of the pivotable contacts 103A, 103B are offset by having the first pivotable contact 103A be a different length than the second pivotable contact 103B. In this embodiment, the pivotable contacts 103A, 103B can be connected at same or different locations relative to the longitudinal axis of the plug body 102.

The end cap 201 comprises an interior 203 that is sized to receive the plug body 102. In one embodiment, the diameter of the interior 203 is equal to a close tolerance of the diameter of the plug body 102 such that the plug body 102 is securely held therein. In one such embodiment, a collar 106 of the plug body 102 can have a diameter substantially equal to the diameter of the interior 203 of the end cap 201 in order to create a frictional fit between the plug assembly 101 and the end cap 201. The collar 106 can additionally comprise an O-ring 107 to assist in sealing and holding the plug assembly 101 in place. In another embodiment, the diameter of the interior 203 is larger than the diameter of the plug body 102. In embodiments of the cable connector assembly wherein the end cap 201 is threadably engaged with the housing 301, the end cap 201 further comprises threading 202 that is complementary to the threading 303, 306 of the connection ends 302, 305 of the housing 301. The threading 202 can be disposed on either an exterior surface or an interior surface, as depicted in FIG. 3, of the end cap 201.

In one embodiment, the plug assembly 101 further comprises one or more gaskets configured to serve as seals between the plug body 102 and the end cap 201. One such embodiment comprises a first gasket 108 configured to seal the end of the cable 501 to the plug body 102 and a second gasket 109 configured to seal the end cap 201. Each of the first gasket 108 and the second gasket 109 comprises an opening therethrough that is sized and shaped to conform to the cable 501 in order to reduce clearance therebetween. In this embodiment, the first and second gaskets 108, 109 can be constructed from the same or different materials. For example, the first gasket 108 can be constructed from silicon rubber and the second gasket 109 can be constructed from polycarbonate. In one embodiment, the second gasket 109 has a diameter equal to a close tolerance of the interior 203 of the end cap 201 such that it is fixed in place when inserted into the end cap 201 and thereby prevents the ingress of moisture through the aperture in the end cap 201 through which the cable 501 extends. Furthermore, the first gasket 108 can be configured to engage the second gasket 109 such that the first gasket 108 is held fixed relative to the second gasket 109.

In one embodiment, the plug body 102 further comprises a ground contact 113. The ground contact 113 can be utilized in connection with the pins 133 for when the plug assembly 101 is utilized with a grounded socket.

The cable connector assembly can further comprise a thimble 110 that is configured to hold the retracted portion of the outer jacket and braid of the cable 501 back from the exposed end of the cable 501. The thimble 110 comprises a central piece with an opening sized and shaped to conform to the cable 501 and two wings 114 extending from opposing edges of the central piece. The wings 114 of the thimble 110 prevent the outer jacket and the braid, which are peeled back to expose the inner jacket of the cable 501 during the installation process, from the exposed end of the cable 501.

Referring back to FIGS. 1-3, one embodiment of the cable connector assembly further comprises a locking mechanism to fixedly secure the end cap 201 in place upon being engaged with or tightened to the housing 301. In one such embodiment, the housing 301 comprises a spring-biased tab 311 that extends from the main body of the housing 301 adjacent to one or more of the connection ends 302, 305. The end cap 201 further comprises one or more slots 204 disposed along the peripheral edge of the opening to be oriented towards the housing 301 when the end cap 201 is being engaged therewith. When the end cap 201 is sufficiently engaged with the housing 301, the spring-biased tab 311 is configured to engage one of the corresponding slots 204 and thereby lock the end cap 201 in place, as depicted in FIG. 2. The slots 204 of the end cap 201 can be shaped such that they are angled in the rotational direction that tightens the end cap 201 to the connection end 302, 305 of the housing 301, such that the slots 204 permit continuous rotary motion over the spring-biased tab 311 in that direction. Conversely, the slots 204 can be shaped to engage with the spring-biased tab 311 and prevent motion in the opposing direction. In this embodiment, the spring-biased tab 311 and the slots 204 thus form a ratcheting locking mechanism. The locking mechanism is configured to prevent the connection between the end cap 201 and the housing 301 from loosening to due vibration, thermal stress, or accidental contact. When desired, the locking mechanism can be disengaged by depressing the spring-biased tab 311, which removes the tab 311 from the slot 204 on the end cap 201 and thereby allows the end cap 201 to be unscrewed or otherwise removed from the housing 301.

Figure 7:
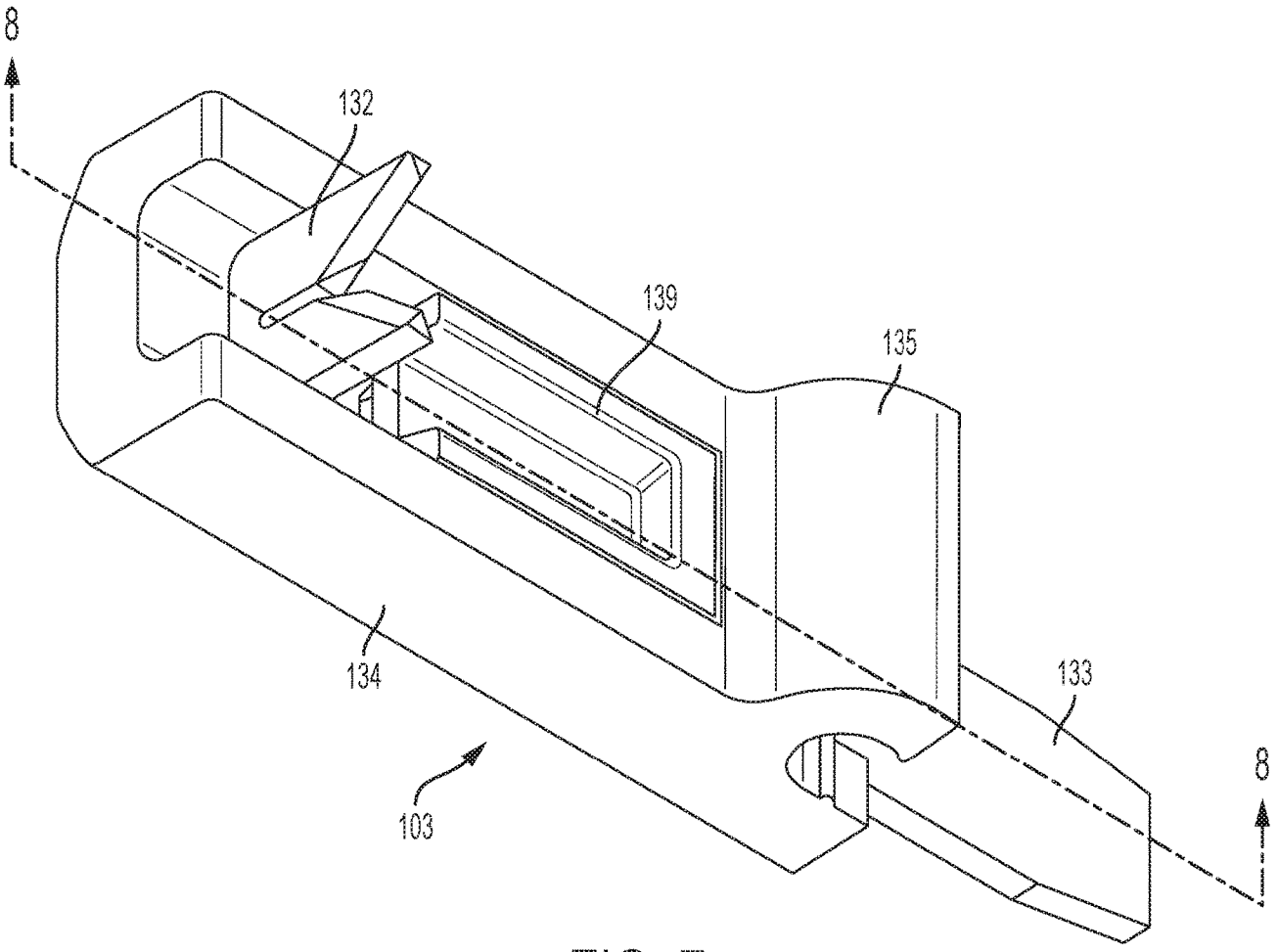
FIG. 7 depicts a perspective view of a pivotable contact according to various embodiments of the present disclosure.
Figure 8:
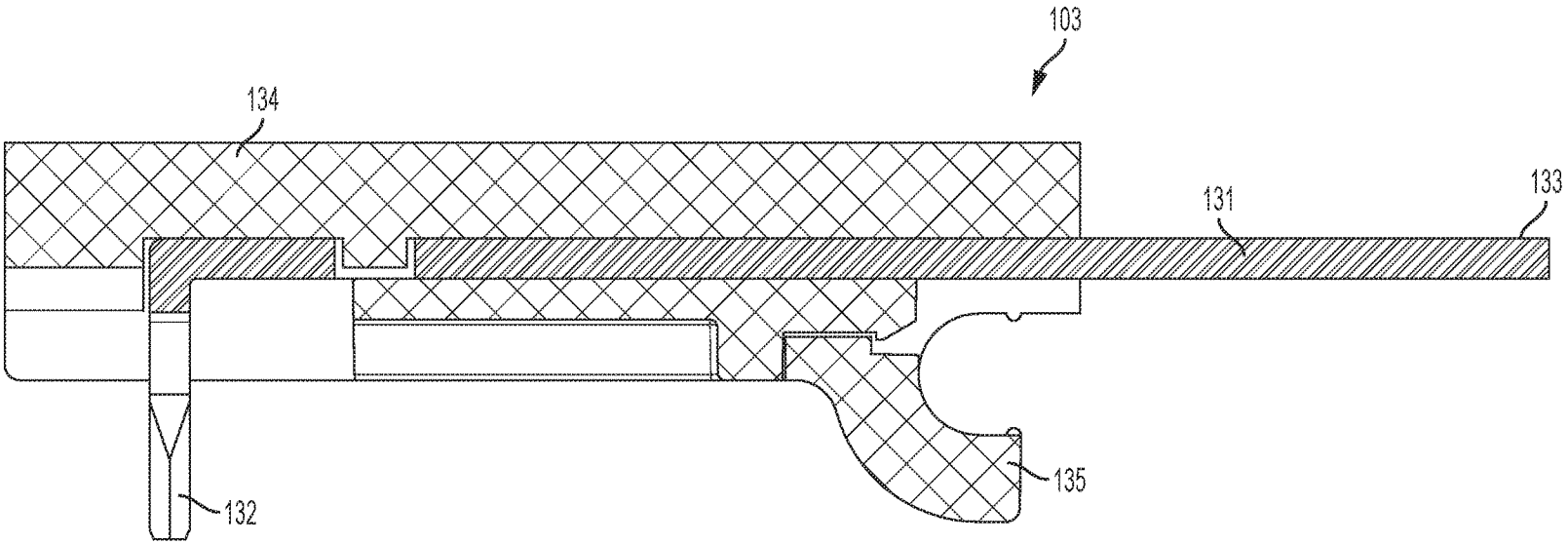
FIG. 8 depicts a sectional view of a pivotable contact along line 8-8 according to various embodiments of the present disclosure.

FIGS. 7-8 show, respectively, a perspective view and a sectional view of a pivotable contact along line 8-8 according to various embodiments of the present disclosure. In the illustrated embodiment, each pivotable contact 103 comprises a housing 134 at least partially enclosing a conductive member 131. The conductive member 131 is constructed from a material capable of carrying an electrical current, e.g., stainless steel. The housing 134 is constructed from a substantially nonconductive material, e.g., polycarbonate. In one embodiment, the housing 134 further comprises a locking insert 139 that is configured to be inserted into the housing 134 to secure the conductive member 131 in place. The locking insert 139 can be secured to the housing 134 via a tab that engages with a corresponding slot or lip on the housing 134, frictional fit, or any other such mechanism known in the field.

The conductive member 131 comprises two opposing ends that extend beyond the housing: a blade 132 and a pin 133. The blade 132 is configured to pierce the jacket of the cable 501 when the pivotable contact 103 is rotated into the plug body 102. In an illustrative embodiment, the blade 132 is oriented so that it is generally orthogonal to the axis of rotation of the pivotable contact 103. In another illustrative embodiment, the blade 132 is oriented orthogonally relative to the housing 134 of the pivotable contact 103. The pin 133 is configured to be received by a corresponding socket disposed within the interior of the housing 301. When the blade 132 has pierced the cable 501 and made contact with the bus wires therein and the pin 133 is engaged with a socket, the conductive member 131 forms an electrical pathway between the bus wires of the cable 501 and the socket, allowing current to flow therebetween.

Figure 9:
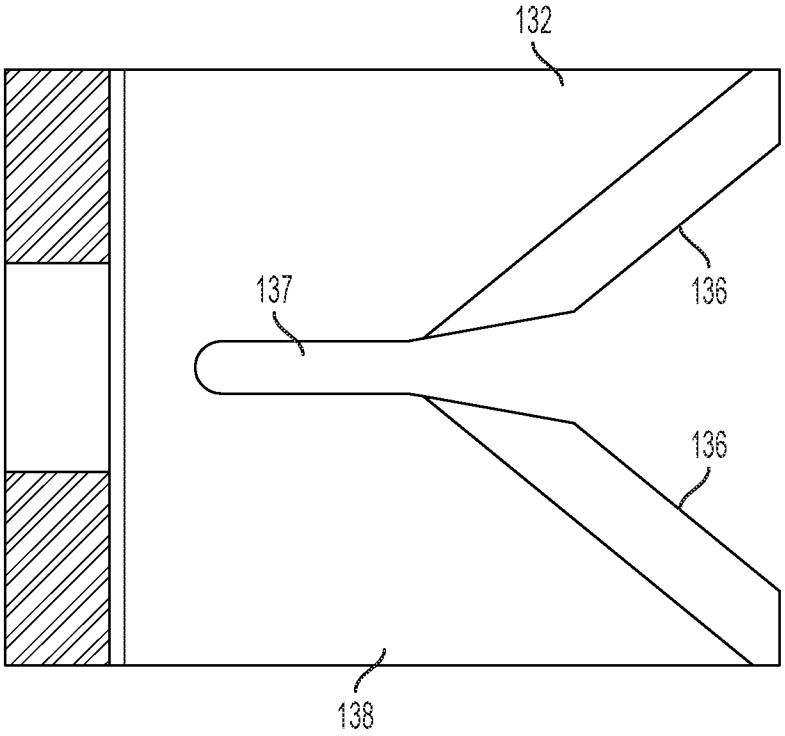
FIG. 9 depicts an elevational end view of a blade of a pivotable contact according to various embodiments of the present disclosure.

FIG. 9 shows an elevational end view of a blade 132 of a pivotable contact according to various embodiments of the present disclosure. The blade 132 of each pivotable contact 103 is configured to pierce the inner jacket and the semi-conductive core of the cable 501 and make contact with, without severing, the electrical bus wires enclosed therein. In one embodiment, the blade 132 comprises a pair of leading edges 137 oriented in a V-shaped arrangement that are separated by a notch 137 extending from the medial ends of the leading edges 136 across the blade surface 138. As cables vary in size, shape, the arrangement of bus wires enclosed thereby, etc., the design and/or shape of the blade 132 can be tailored to specific types of cables. For example, for an embodiment specifically configured for use with Chromalox SRF heat trace cables, the notch 137 separating the leading edges 136 has a width of 0.70±0.10 mm, which corresponds to a close tolerance of the diameter of a bus wire of the Chromalox SRF heat trace cable, and the leading edges 136 are oriented at approximately 78° with respect to each other. This arrangement allows the blade 132 to receive the bus wires of a SRF heat trace cable without causing damage thereto and self-center the SRF heat trace cable by snugly engaging each bus wire.

Figure 10:
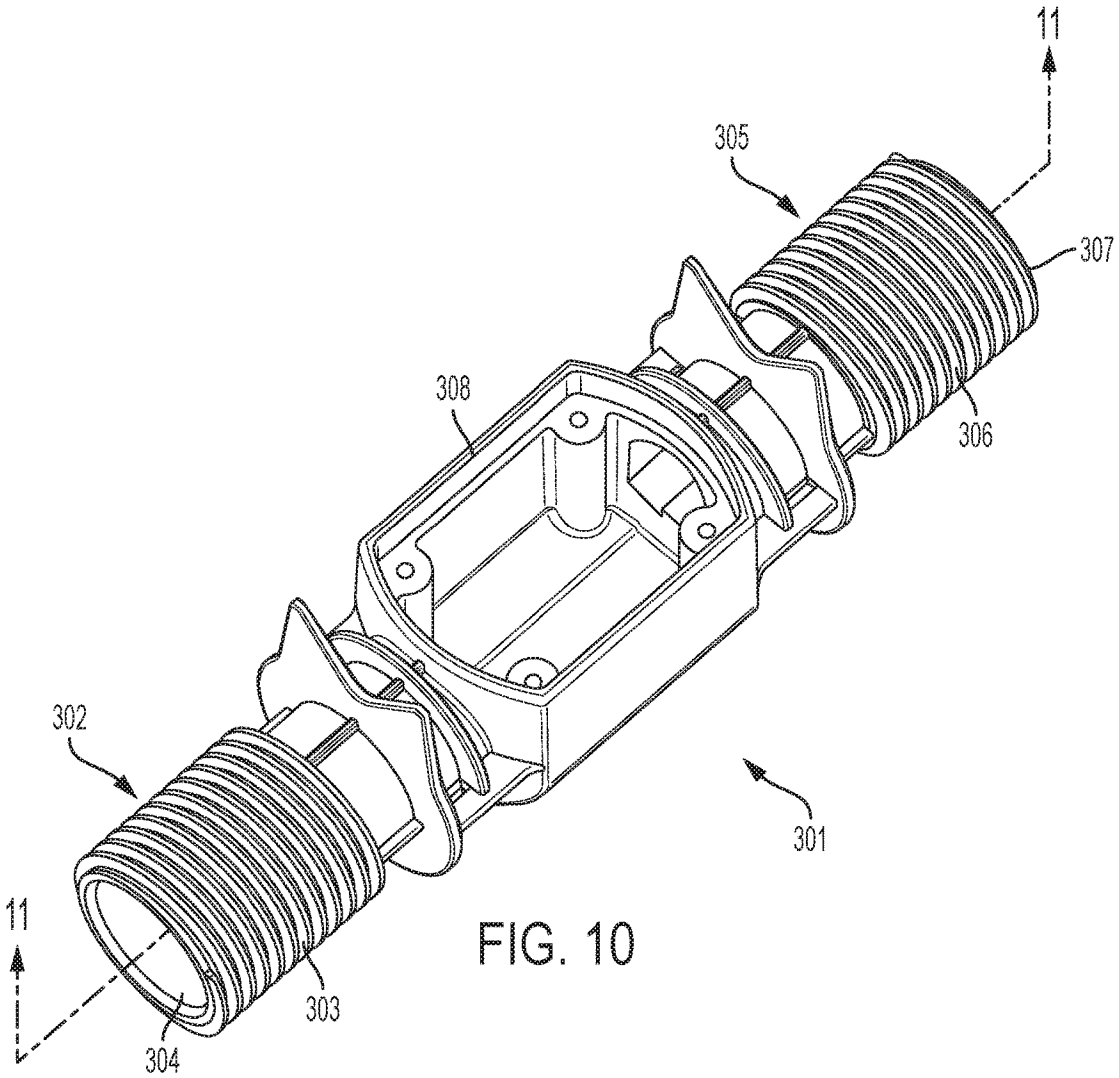
FIG. 10 depicts a perspective view of a housing according to various embodiments of the present disclosure.
Figure 11:
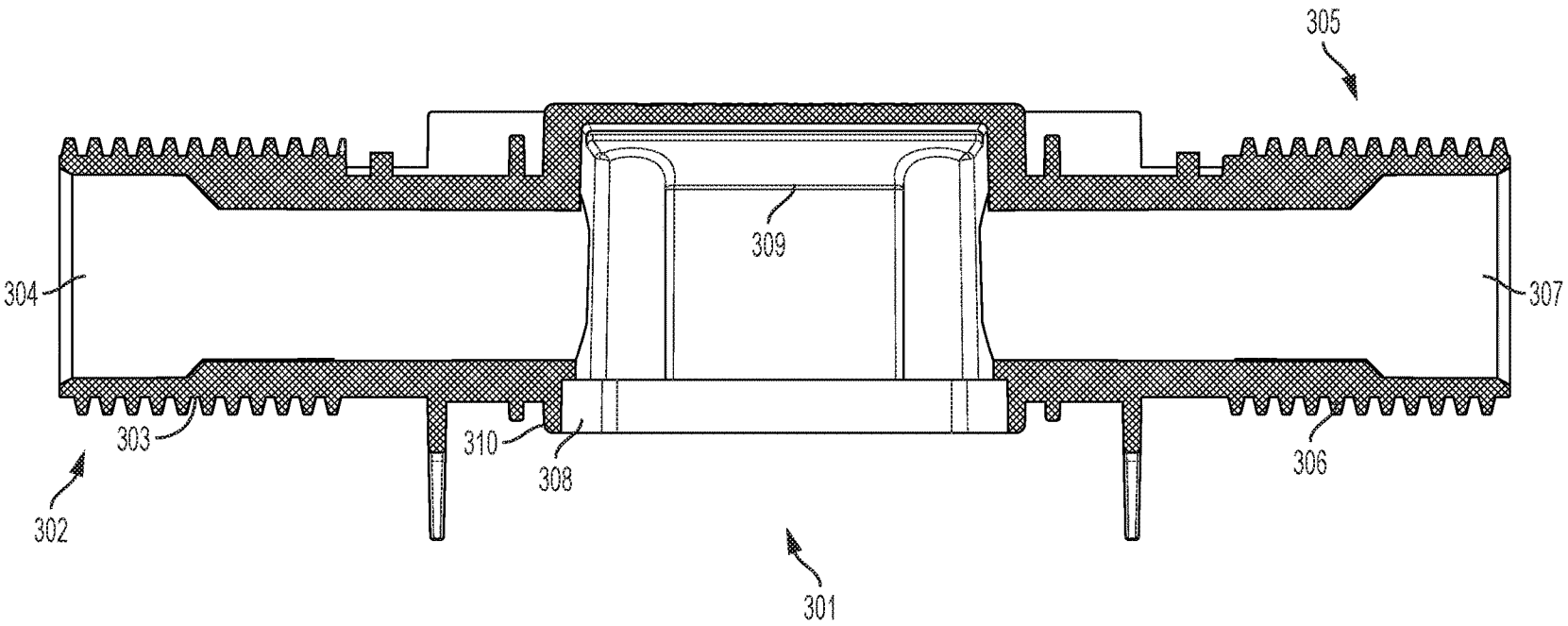
FIG. 11 depicts a sectional view of a housing along line 11-11 according to various embodiments of the present disclosure.

Referring now to FIGS. 10-11, there are shown, respectively, a perspective view of a housing and a sectional view of a housing along line 11-11 according to various embodiments of the present disclosure. One embodiment of the housing 301 comprises a first connection end 302 and a second connection end 305 to each of which an end cap 201 is connectable. In alternative embodiments, the housing 301 can comprise three or more connection ends, along with the appropriate corresponding internal structures. In an illustrative embodiment, the first and second connection ends 302, 305 each comprise threading 303, 306 disposed on an exterior surface thereof that is configured to mesh with the corresponding threading 202 of the end caps 201. The first and second connection ends 302, 305 further comprise first and second channels 304, 307, respectively, that are sized and shaped to receive a plug assembly 101, a power plug assembly 401, or another such adapter structure.

The housing 301 further comprises an interior 309 in connection with the first channel 304 and the second channel 307. The interior 309 is sized and shaped to receive the socket assembly 321 such that the sockets 322, 323 align with the channels 304, 307 of the connection ends 302, 305. The interior 309 can be accessed by an opening 308 extending through the housing 301, such as an opening 308 positioned on the underside of the housing 301, as shown in FIGS. 10-11. The opening 308 preferably is sized and shaped to conform to a closer tolerance to the base 324 of the socket assembly 321 such that there is little to no clearance between the socket assembly base 324 and the opening 308. In one embodiment, the opening 308 and the socket assembly base 324 form a watertight connection via frictional fit or any other such mechanism known in the field.

In one embodiment, the socket assembly base 324 is flush with the surface of the housing 301 when secured therein. In another embodiment, the socket assembly base 324 is recessed from the surface of the housing 301 when secured therein. In another embodiment, the housing 301 further comprises a lip 310 that projects from and extends about a peripheral edge of the opening 308. The lip 310 prevents water flow that comes in contact with the housing 301 from wicking into or otherwise entering the housing 301 through the opening 308 by serving as a barrier protecting the seam between the peripheral edge of the opening 308 and the base 324 of the socket assembly 321.

FIGS. 12-13 show an exploded view and a perspective view of a socket assembly according to various embodiments of the present disclosure. In an illustrative embodiment, the socket assembly 321 comprises the first and second sockets 322, 323 that are in electrical communication with each other, and a base 324. The first and second sockets 322, 323 are configured to be aligned with the connection ends 302, 305 of the housing 301, thereby allowing an electrical plug, e.g., the plug assembly 101, to enter the housing 301 through the channels 304, 307 of the connection ends 302, 305 and be received by the corresponding socket 322, 323.

In alternative embodiments, the socket assembly 321 can comprise three or more sockets in a variety of different arrangements. For example, the socket assembly 321 can comprise a pair of sockets opposing, and in electrical communication with, a third socket. In another embodiment, the socket assembly 321 can comprise opposing pairs of sockets that are in electrical communication. In these embodiments, the number and arrangement of the sockets can correspond to the number and arrangement of the connection ends 302, 305 of the housing 301 through which a plug assembly 101 and other such electrical adapters are connectable to the socket assembly 321.

In one embodiment, the sockets 322, 323 comprise contacts 325 that are spring-biased or flexible such that they self-align with the pins of the plug assembly 101 or other electrical adapters, e.g., the power plug assembly 401. In one such embodiment, the contacts 325 of the sockets 322, 323 comprise a crimp 326 or bend disposed along their lengths. The crimp 326 allows the contacts 325 to laterally flex or deform to provide a degree of tolerance in receiving the pins of an electrical plug. Stated differently, if a pin of an electrical plug is misaligned with the corresponding slot of the socket 322, 323 and instead makes contact with the edge of the electrical contact 325, the electrical contact 325 is configured to laterally deform and thereby allow the slot of the socket 322, 323 to nonetheless receive the misaligned pin. Furthermore, the contacts 325 can be constructed from a material that has sufficient elasticity that it substantially returns to its default position upon the plug being removed from the corresponding socket 322, 323.

Figure 14:
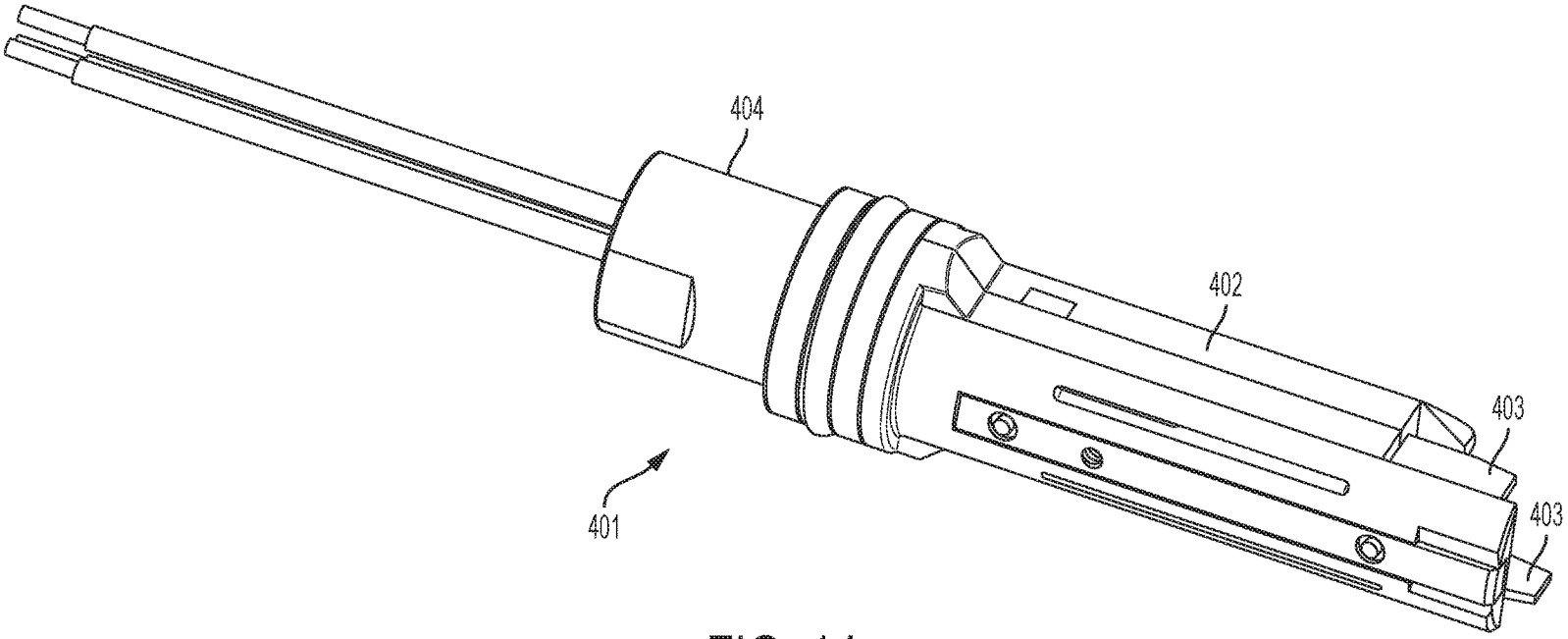
FIG. 14 depicts a perspective view of a power plug assembly according to various embodiments of the present disclosure.
Figure 15:
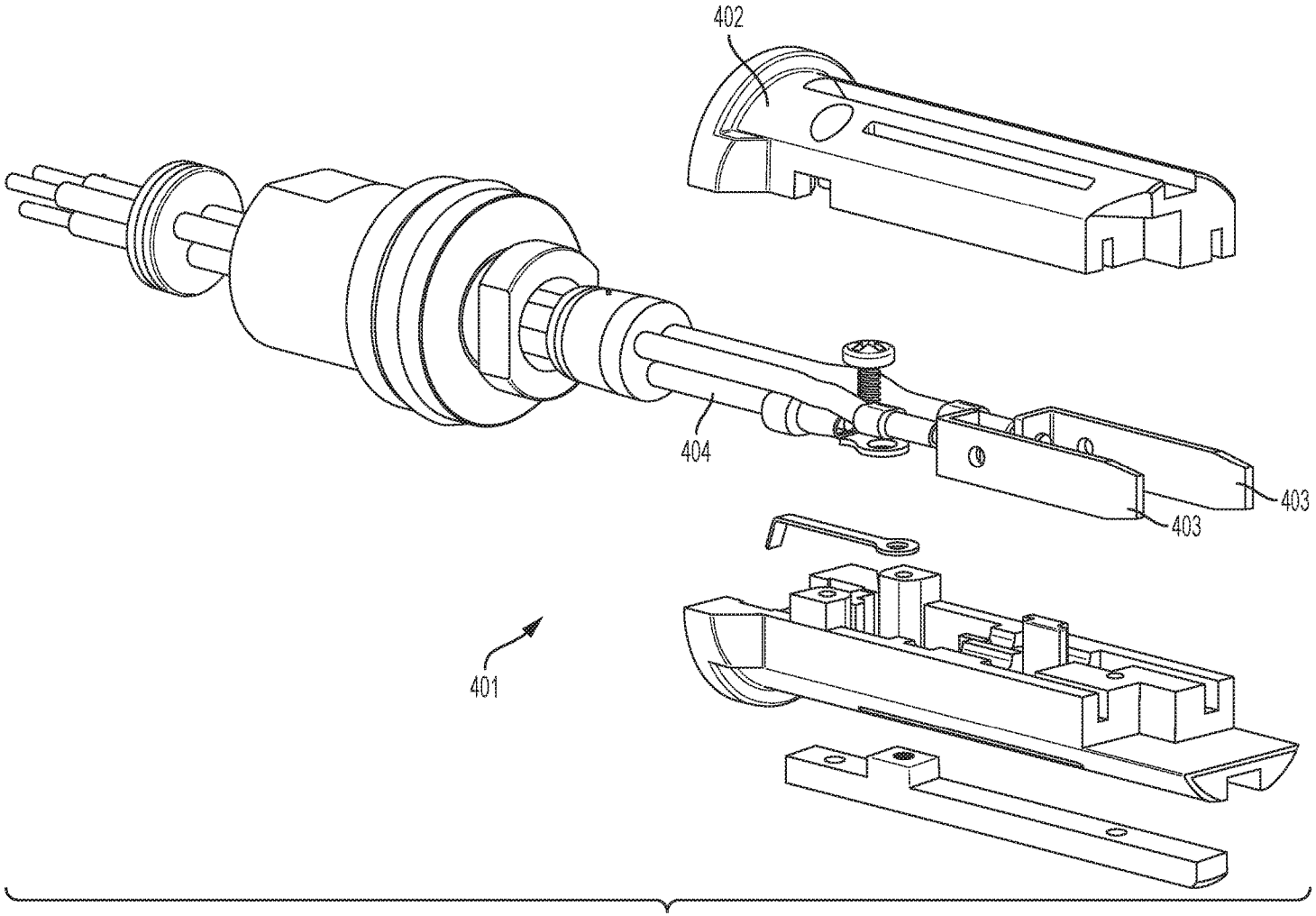
FIG. 15 depicts an exploded view of a power plug assembly according to various embodiments of the present disclosure.

Referring now to FIGS. 14-15, there are shown, respectively, a perspective view and an exploded view of a power plug assembly according to various embodiments of the present disclosure. In one embodiment, the cable connector assembly further comprises a power plug assembly 401. The power plug assembly 401 comprises a plug body 402 which is configured to be received within one or more of the connection ends 302, 305 of the housing 301, pins 403 that are configured to be received by the socket assembly 321, and an electrical conduit 404 that is connected or connectable to a power source. The power plug assembly 401 serves as an adapter for connecting the cable connector assembly, and thus any cable 501 that is connected to the cable connector assembly, to a power source.

The embodiment of the cable connector assembly depicted in FIGS. 1-2 includes a plug assembly 101 that is configured to be installed upon the end of a cable 501, a power plug assembly 401 that is connected to a power source, and a housing 301 including two connection ends 302, 305. However, various other embodiments of the cable connector assembly can include two plug assemblies in lieu of a single plug assembly and a power plug assembly, housings that include more than two connection ends, and various other combinations of plug assemblies, power plug assemblies, and housings configured to receive different numbers of plug assemblies and power plug assemblies. Some such embodiments will be discussed in further detail below.

Figure 16:
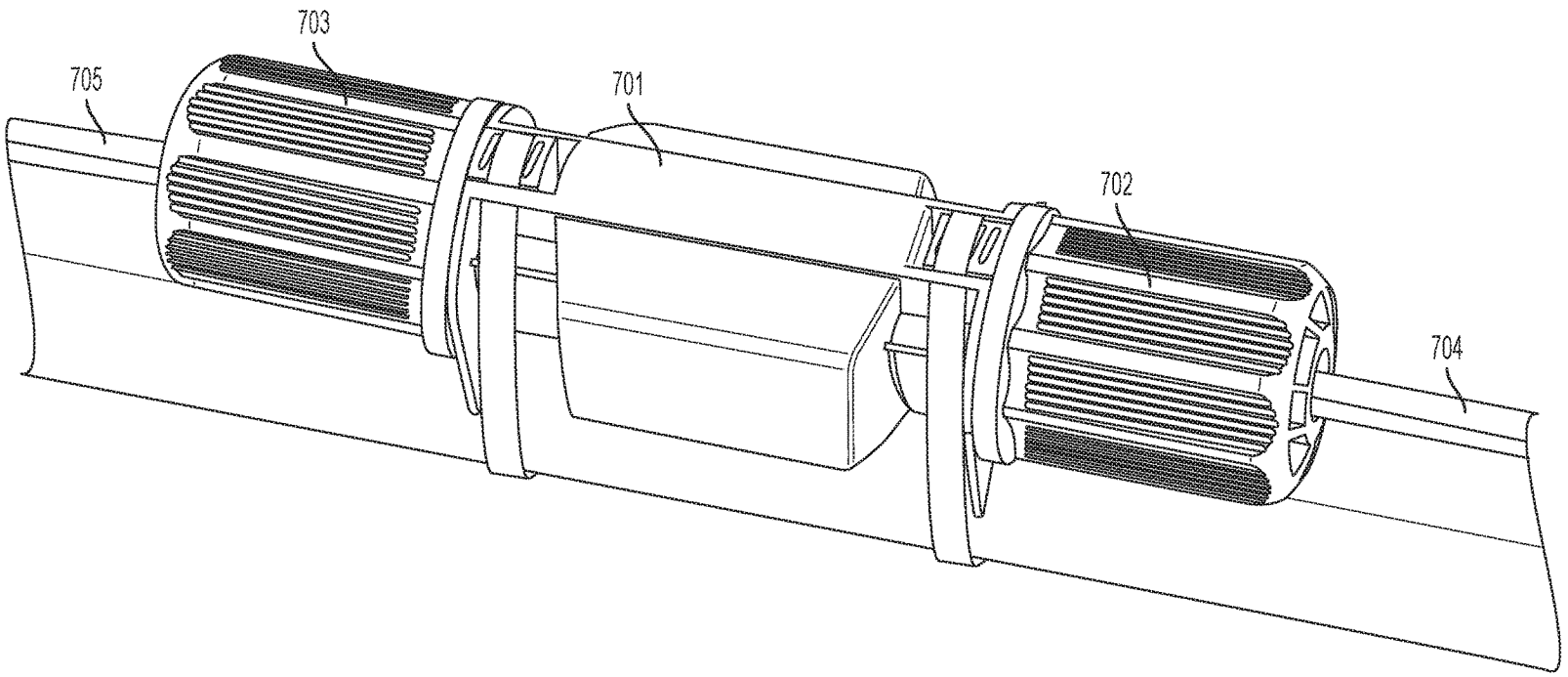
FIG. 16 depicts a perspective view of a cable connector assembly according to various embodiments of the present disclosure.

Referring now to FIG. 16, there is shown a perspective view of a cable connector assembly according to various embodiments of the present disclosure in which the cable connector assembly comprises a two-ended housing 701 that is configured to engage both a first plug body and end cap 702, which terminates a first cable 704, and a second plug body and end cap 703, which terminates a second cable 705. The cable connector assembly further comprises a socket assembly internal to the housing 701 comprising two sockets in electrical communication, wherein each socket is aligned with one of the connection ends of the housing 701. The kit of the cable connector assembly in this embodiment is provided for joining two separate electrical cables together.

Figure 17:
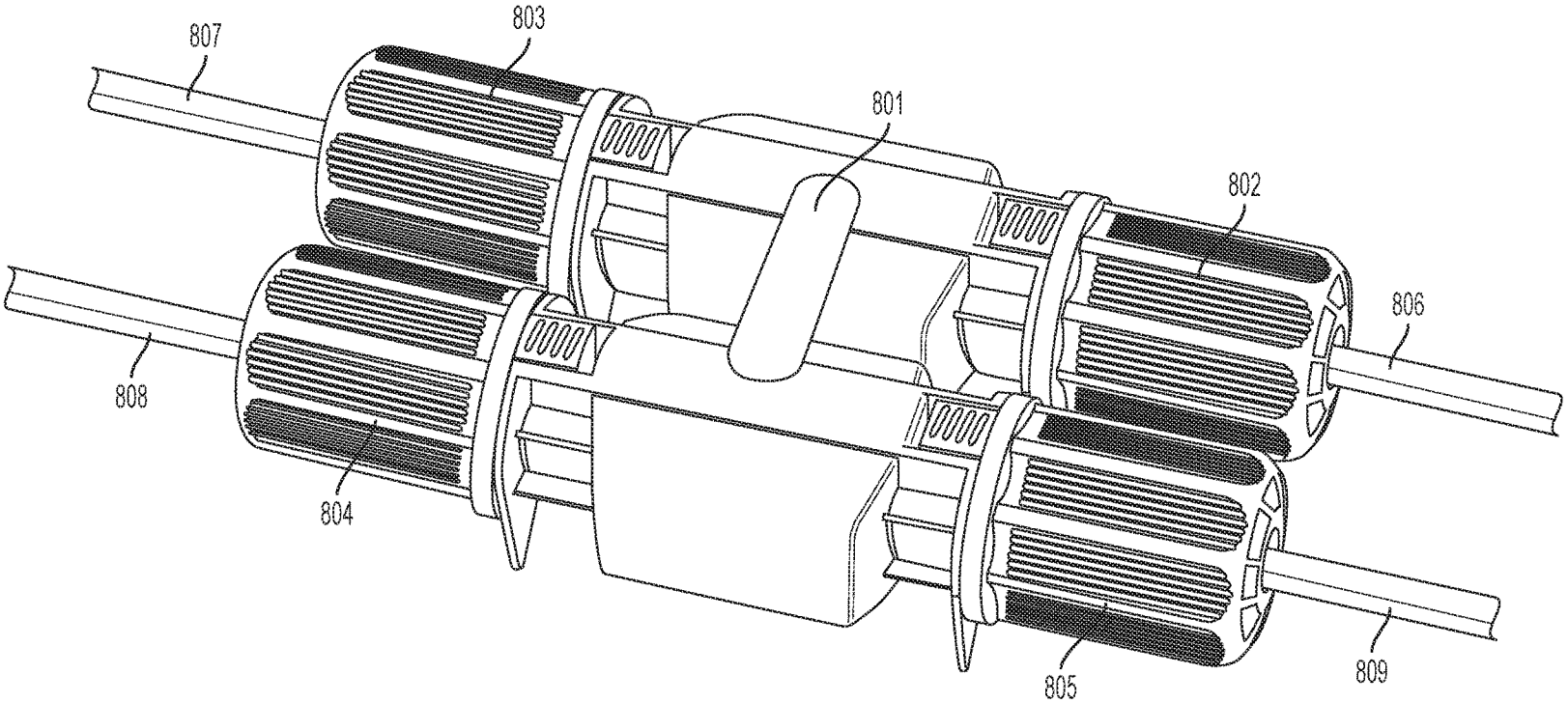
FIG. 17 depicts a perspective view of a cable connector assembly according to various embodiments of the present disclosure.

Referring now to FIG. 17, there is shown a perspective view of a cable connector assembly according to various embodiments of the present disclosure. In this embodiment, the cable connector assembly comprises a four-ended housing 801 that is configured to engage a first plug body and end cap 802, which terminates a first cable 806, a second plug body and end cap 803, which terminates a second cable 807, a third plug body and end cap 804, which terminates a third cable 808, and a fourth plug body and end cap 805, which terminates a fourth cable 809. The cable connector assembly further comprises a socket assembly internal to the housing 801 comprising four sockets, wherein each socket is aligned with one of the connection ends of the housing 801. In this embodiment, the sockets can be connected such that they are electrically connected in pairs or such that all four sockets are electrically connected to each other. The kit of the cable connector assembly in this embodiment is provided for joining four separate electrical cables together.

Figure 18:
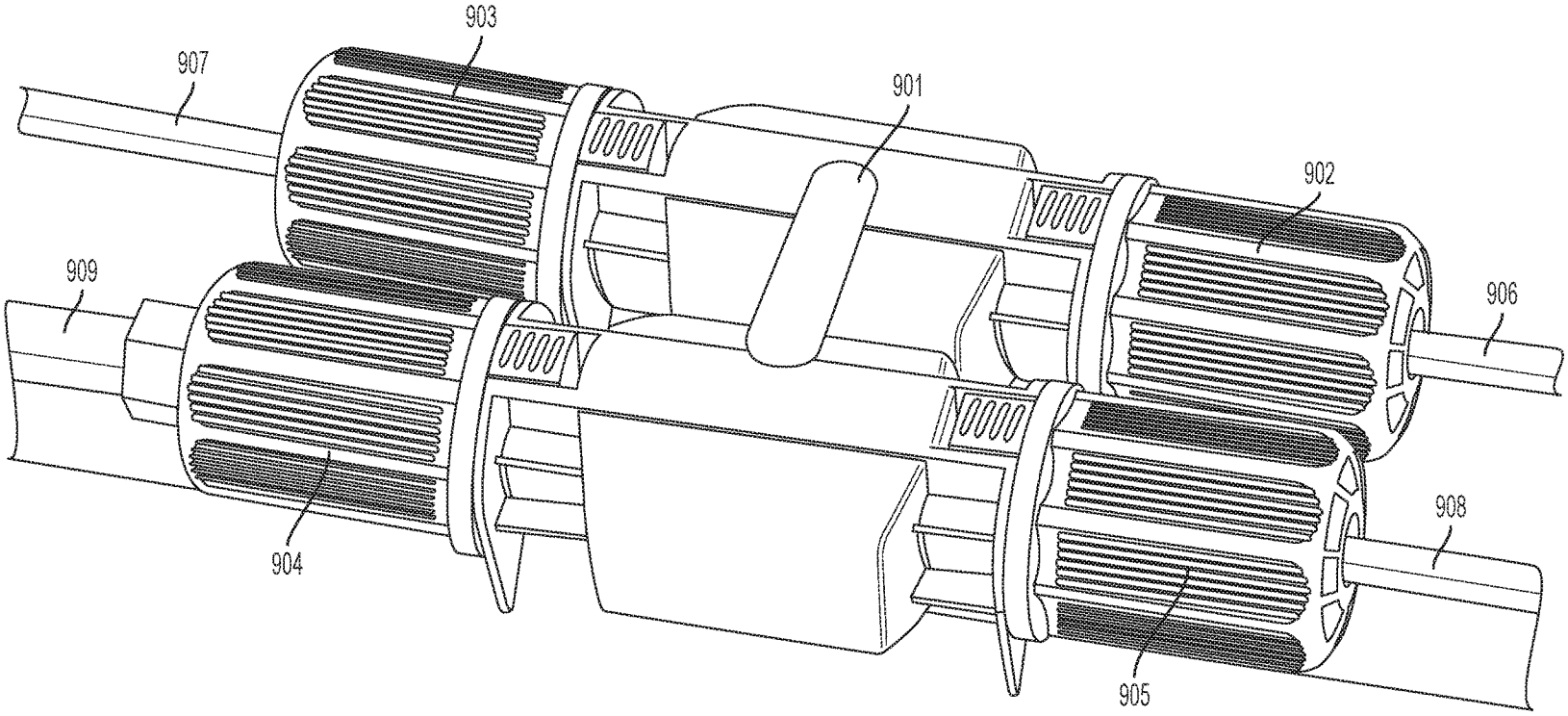
FIG. 18 depicts a perspective view of a cable connector assembly according to various embodiments of the present disclosure.

Referring now to FIG. 18, there is shown a perspective view of a cable connector assembly according to various embodiments of the present disclosure. In this embodiment, the cable connector assembly comprises a four-ended housing 901 that is configured to engage a first plug body and end cap 902, which terminates a first cable 906, a second plug body and end cap 903, which terminates a second cable 907, a third plug body and end cap 904, which terminates a third cable 908, and a power plug adapter and end cap 905, which terminates electrical wiring that is connected to a power source. The cable connector assembly further comprises a socket assembly internal to the housing 901 comprising four sockets, wherein each socket is aligned with one of the connection ends of the housing 801. In this embodiment, the sockets can be connected such that they are electrically connected in pairs or such that all four sockets are electrically connected to each other. The kit of the cable connector assembly in this embodiment is provided for joining three separate electrical cables to a power source.

It should be recognized that various embodiments of the housings depicted in FIGS. 1 and 16-18 can include a number of different configurations, with a varying number of connection ends, and for the purpose of joining various combinations of cables, power sources, and other electrical adapters together.

Figure 19:
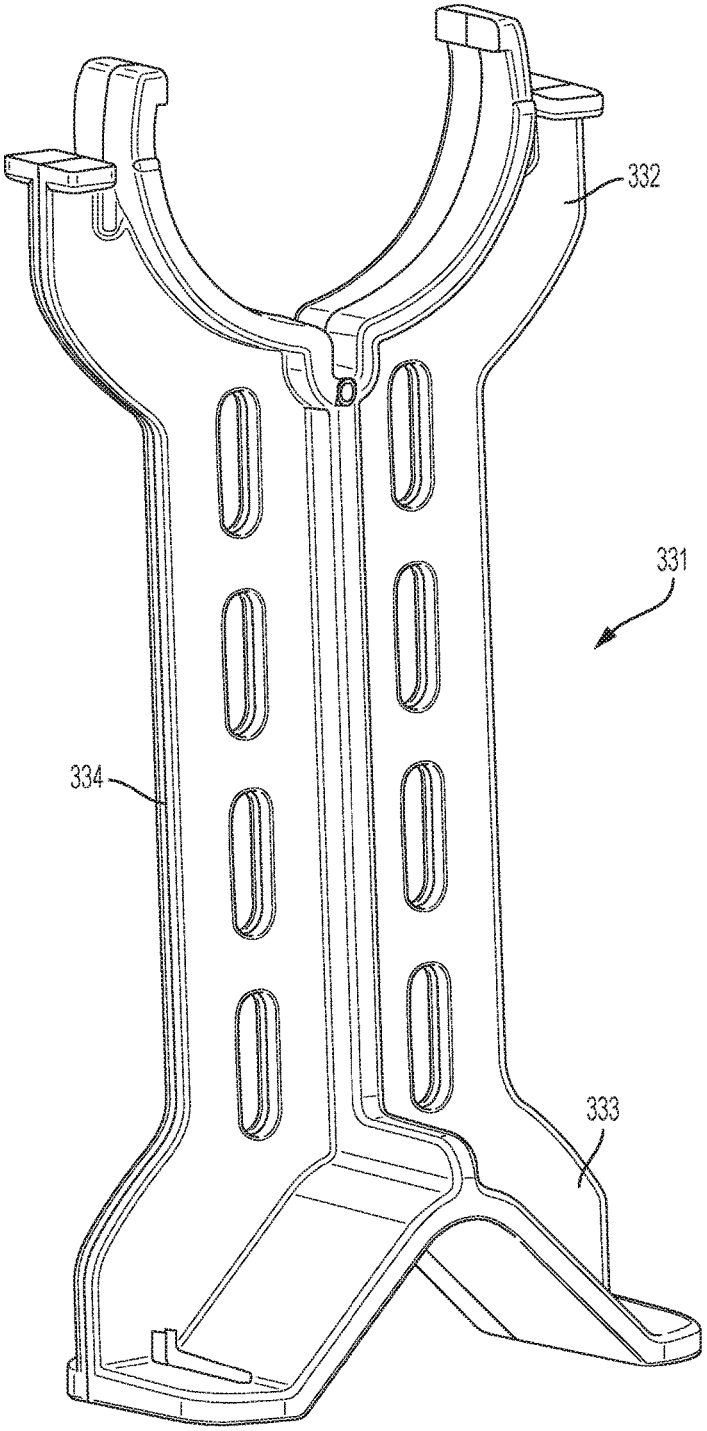
FIG. 19 depicts a perspective view of an extension leg according to various embodiments of the present disclosure.

As shown in the example embodiment of FIG. 1, the cable connector assembly can comprise one or more extension legs 331 that are attachable to the housing 301. FIG. 19 shows a perspective view of such an extension leg 331 according to various embodiments of the present disclosure. The extension leg 331 may comprise a first end 332 connected to a second end 333 via an elongated member 334. The length of the elongated member 334 can vary according to different embodiments of the cable connector assembly based on the particulars of each intended application. The first end 332 can be configured to be secured to a corresponding portion of the housing 301 via a snap-fit connection or another type of removable connection. The second end 333 can be configured to be secured to a pipe or another support surface. As with the first end 332, the second end 333 can function via a snap-fit connection or another such removable connection. Alternatively, the second end 333 can comprise a surface that is molded to conform to the surface on which the extension leg 331 is supported and simply rests thereon. The extension legs 331 are useful for situations in which it is desirable to provide a separation distance between the cable 501 being terminated and the pipe or support surface along which the cable 501 is run. One such situation is when it is desired to install insulation between a heat trace cable and the pipe that the heat trace cable is following. In such a situation, the extension legs 331 provide the room between the cable connector assembly and the pipe to accommodate the insulation. In an alternative embodiment, the extension legs 331 are integrally affixed or otherwise non-removably attached to the housing 301.

In various embodiments where the cable connector assembly is provided as a kit, the kit can additionally include a cutting tool, e.g., a knife, and a measuring tool, e.g., a ruler, either as separate components within the kit or as integral to the housing 301 or another component of the kit. In one embodiment, the cutting tool and the measuring tool are disposed on or otherwise connected to the housing 301. The cutting tool can include a knife that is removably connected to the housing, a blade that is retractably connected to the housing, and other such arrangements that allow for the cutting tool to be utilized for removing the outer jacket from the cable 501 and exposing the underlying inner jacket. The measuring tool can include a ruler or measurement indicia that are screen printed onto the housing 301, etched onto the housing 301, or molded on the housing 301 as part of the fabrication process of the housing 301.

Figure 20:
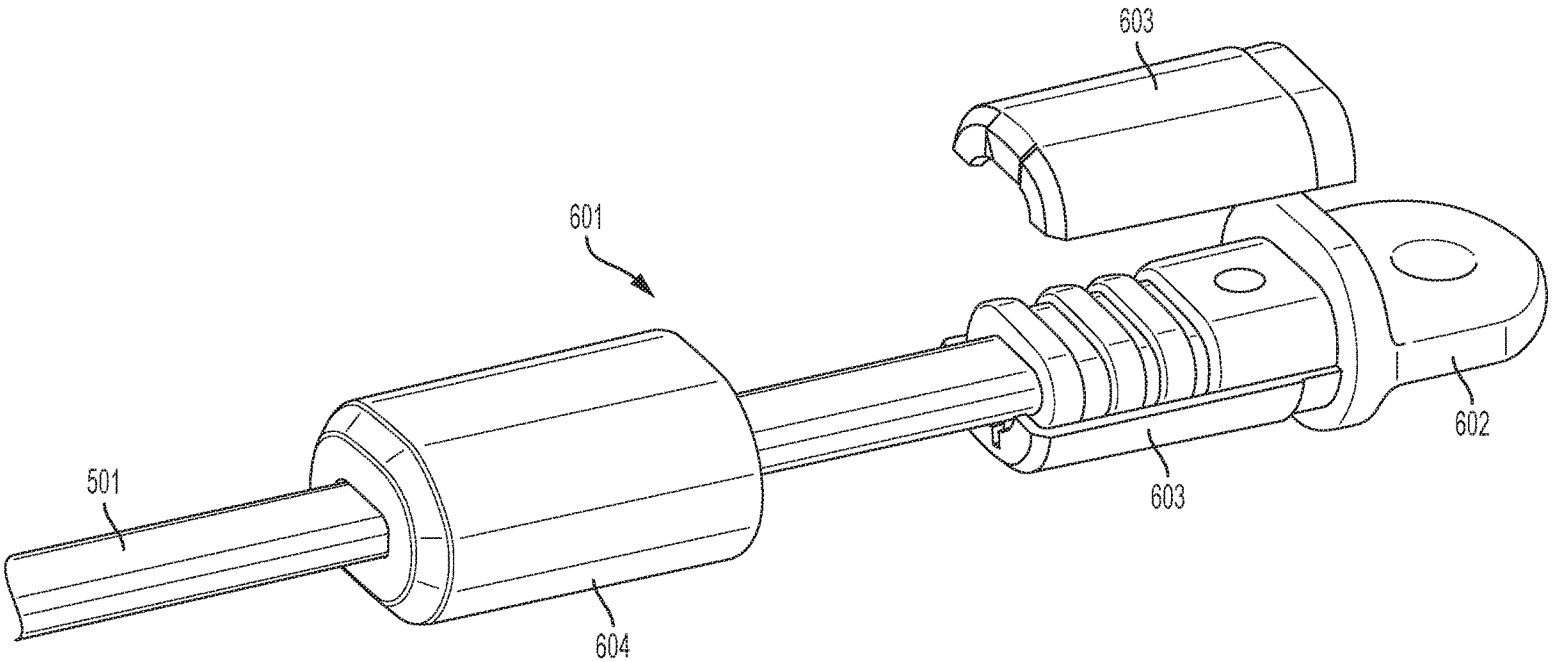
FIG. 20 depicts an exploded view of an end seal connector according to various embodiments of the present disclosure.
Figure 21:
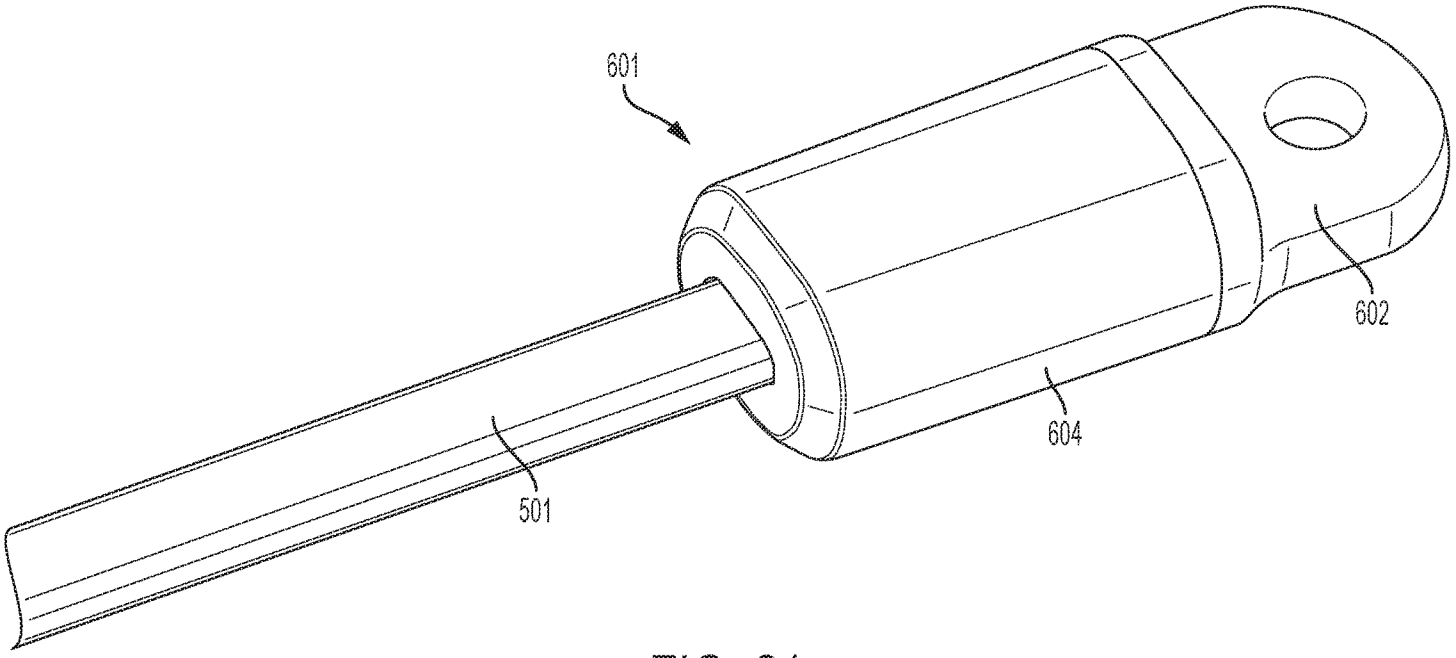
FIG. 21 depicts a perspective view of an end seal connector according to various embodiments of the present disclosure.

Referring now to FIG. 20-21, there is shown a perspective view of an end seal connector according to various embodiments of the present disclosure. In one embodiment, the cable connector assembly or kit comprises an end seal assembly 601 as a means for non-permanently terminating a cable 501. The end seal assembly 601 comprises a grommet 602 that is configured to receive the end of the cable 501 therein. The grommet 602 can be constructed from a nonconductive material, e.g., silicon rubber. Once the grommet 602 is in place on the end of the cable 501, the body halves 603 are then clipped together over the grommet 602 and the sleeve 604 is slid over the aligned body halves 603 to securely hold the grommet 602 in place at the end of the cable 501.

Figure 22:
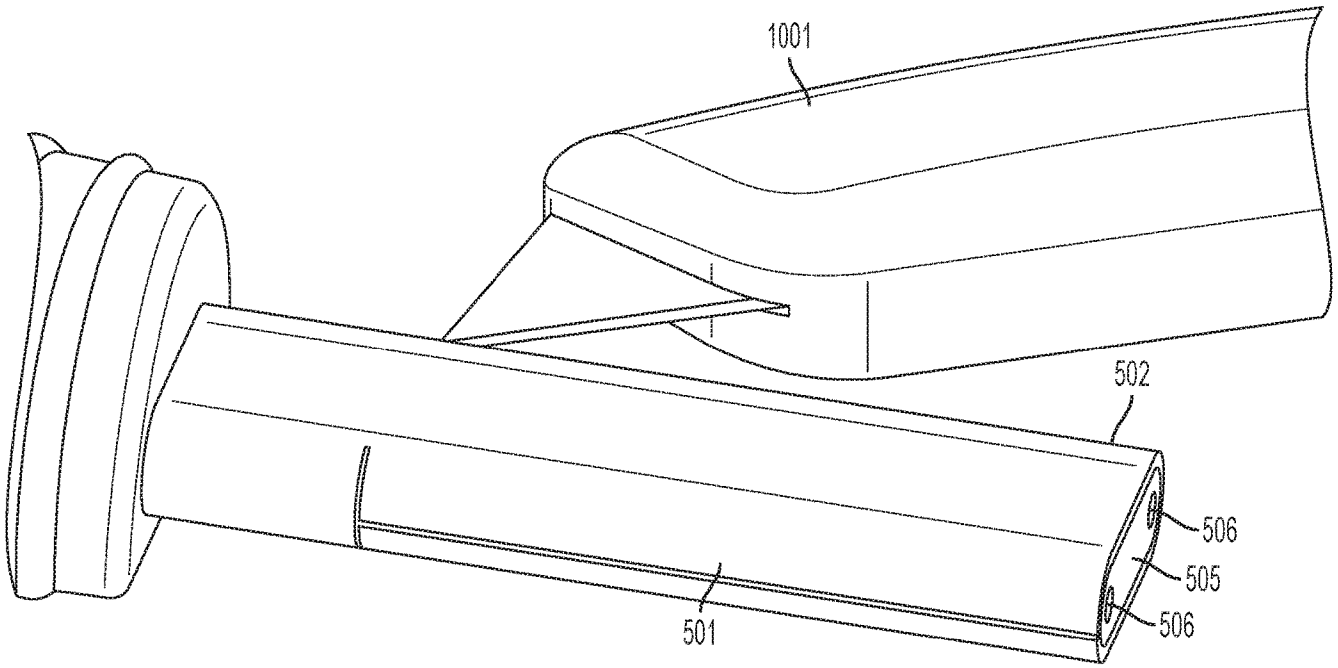
FIG. 22-27 depicts views of a process of utilizing a cable connector assembly according to various embodiments of the present disclosure to connect a cable to the housing.
Figure 23:
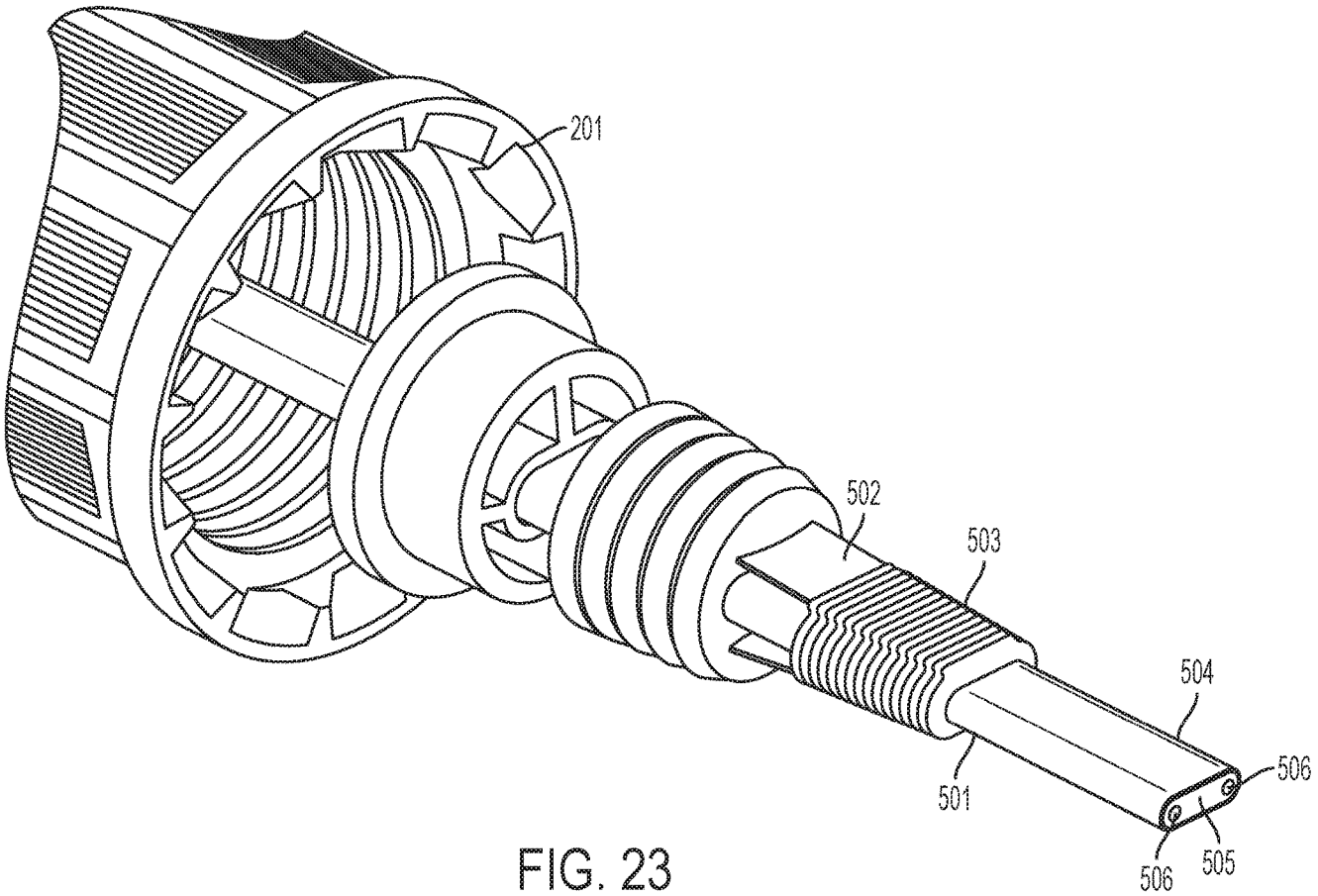

Referring now to FIGS. 22-27, there are shown views of a process of utilizing a cable connector assembly according to various embodiments of the present disclosure to connect a cable to the housing. The steps depict retrofitting the cable connector assembly to a heat trace cable so that the heat trace cable can then be connected to another heat trace cable or a power source via the housing. The first step of the process, as depicted in FIG. 22, is to cut slits through a length of the outer jacket 502 of the connection end of the cable 501 using a cutting tool 1001. The cutting tool 1001 may or may not be provided as an element of the kit of the cable connector assembly. The length of the slits can vary according to the embodiment of the cable connector assembly, but in one embodiment the desired length is 1.25 inches. When the slits are cut, care should be made to avoid cutting through the inner jacket 504, the conductive core 505, and the bus wires 506. After the slits are cut, the next step is to peel back or retract the outer jacket 502 and the braid 503 of the heat trace cable 501 to expose the inner jacket 504 thereunder, which encloses the conductive core 505 and the bus wires 506, as depicted in FIG. 23. A thimble 110 may then be placed over the bundle of the retracted outer jacket 502 and braid 503 in order to hold the bundled materials in place, as depicted in FIG. 3.

Figure 24:
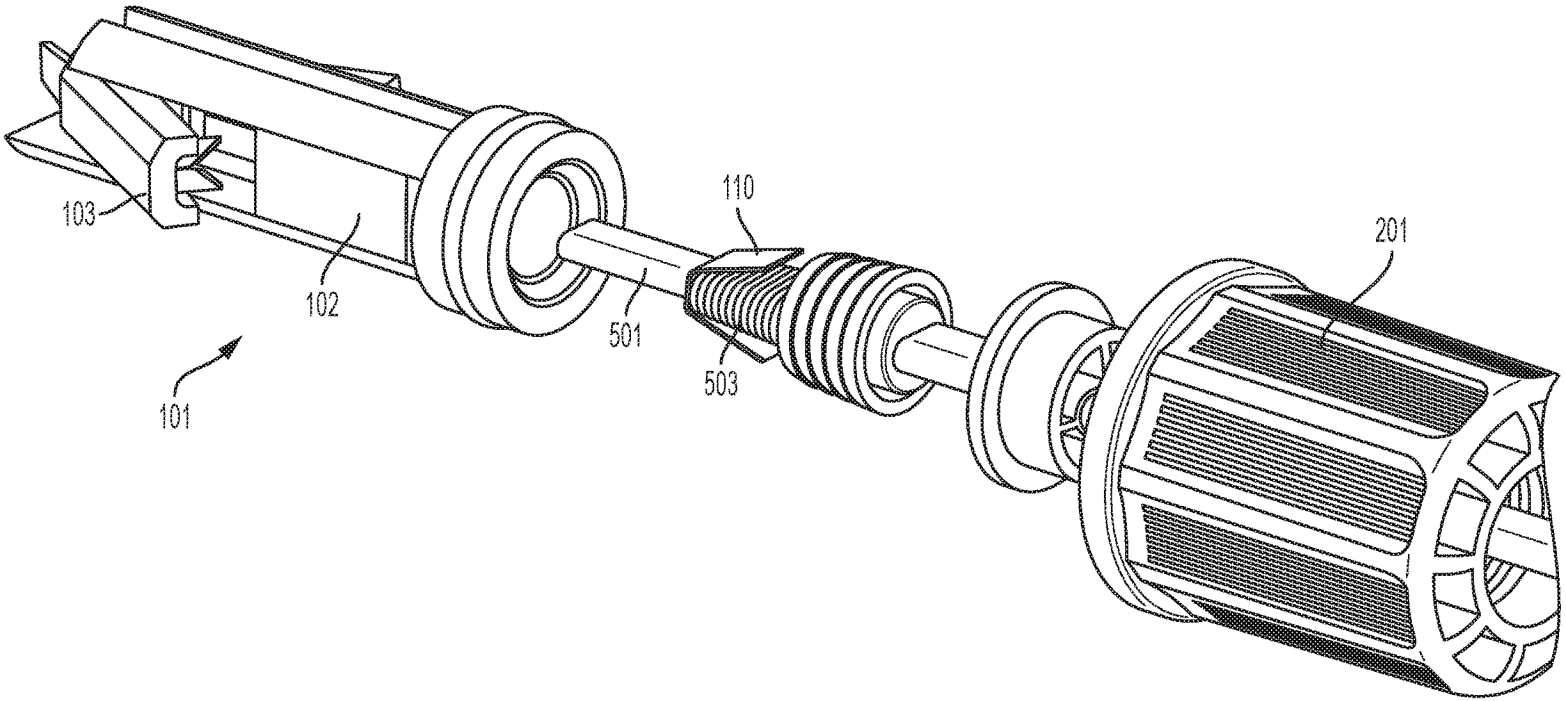
Figure 25:
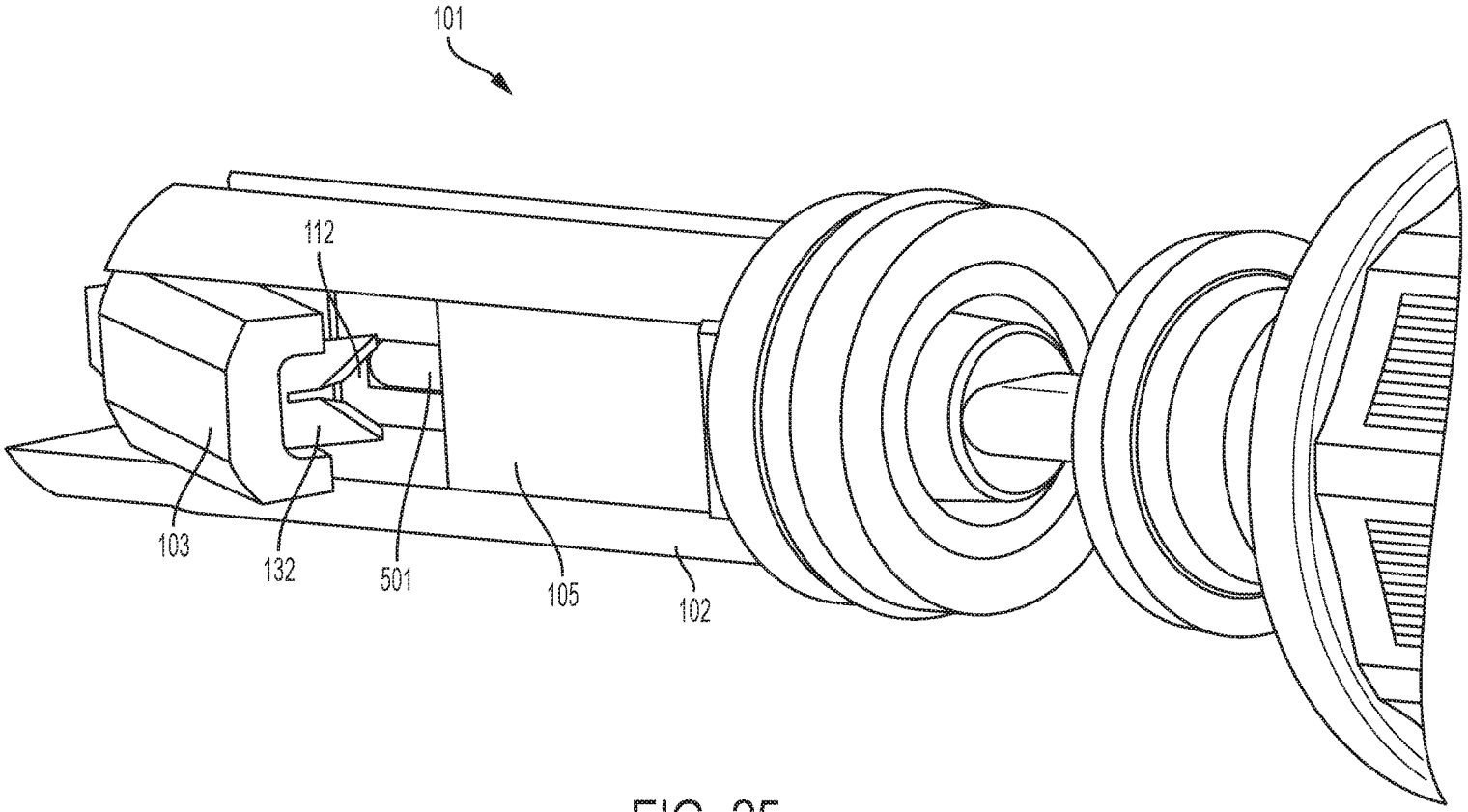
Figure 26:
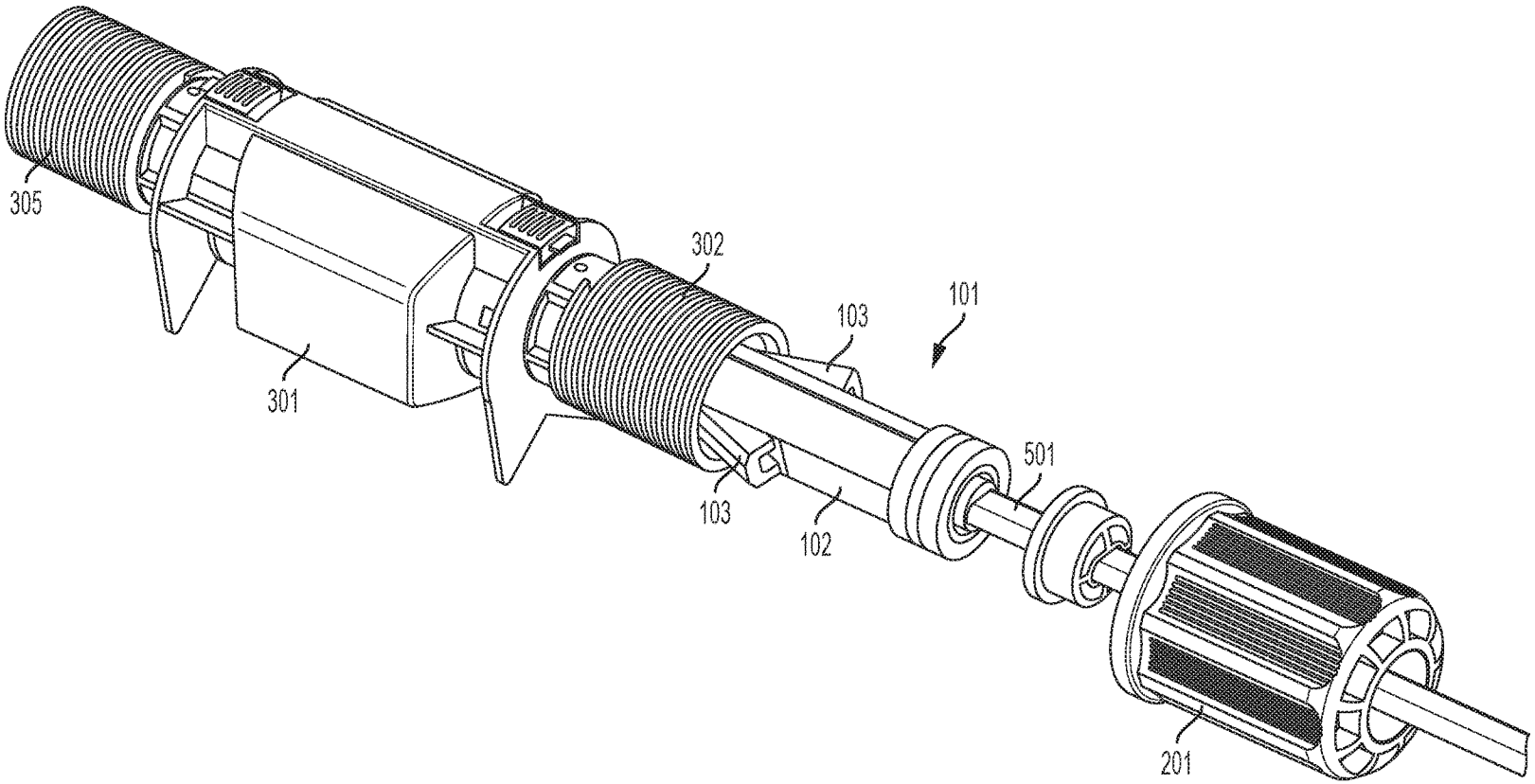
Figure 27:
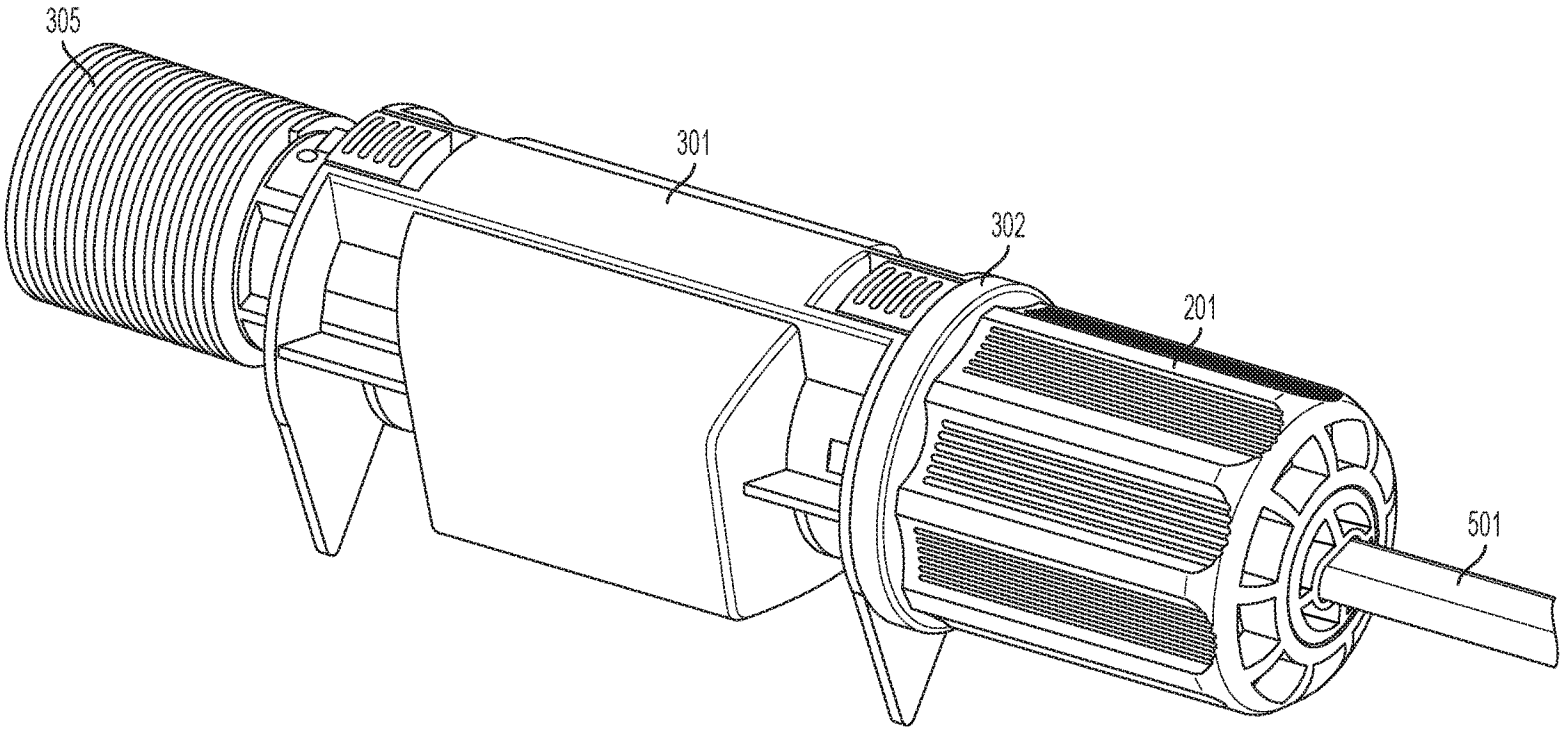

Once the connection end of the cable 501 is exposed, the cable 501 is then inserted into the plug body 102, as depicted in FIG. 24, until the end of the cable contacts the notch 112 or end stop within the interior 105 of the plug body 102, as depicted in FIG. 25. Once the cable 501 is placed within the plug body 102, the plug assembly 101 is then inserted in a connection end 302 of the housing 301, as depicted in FIG. 26. As the plug assembly 101 is inserted into the connection end 302, the pivotable contacts 103 pivoted inwardly by the connection end 302, the blades 132 of the pivotable contacts 103 pierce the exposed inner jacket 504 of the connection end of the cable 501 and make contact with the bus wires therein. The end cap 201 is then screwed and locked into place on the housing, as depicted in FIG. 27. When the end cap 201 is fully secured to the housing 301, the plug assembly 101 is fully enclosed by the end cap 201 and the housing 301. A second cable can then be connected to the cable 501 via the opposing connection end 305 utilizing a second plug assembly in a manner just as described above. Alternatively, a power source can be connected to the cable 501 via the opposing connection end 305 utilizing a power plug assembly, which is shown and described above.

According to one general aspect, therefore, the present disclosure is directed to a kit that comprises a plug body, a housing, and an end cap. The plug body comprises an opening sized to receive a cable, the cable comprising first and second electrical wires and a jacket surrounding the first and second electrical wires. The plug body also comprise first and second members. The first member is pivotably connected to the plug at a first position and comprises a first blade extending inwardly relative to the plug body and a first electrical contact. The second member is pivotably connected to the plug at a second position and comprises a second blade extending inwardly relative to the plug body and a second electrical contact, where the second position is longitudinally offset from the first position. The housing comprises a socket to receive the first electrical contact and the second electrical contact and the end cap is threadably engageable with the housing, with the end cap comprising an interior sized to receive the plug body. Also, engaging the end cap with the housing causes the first member and the second member to contact the housing and pivot inwardly such that the first blade and the second blade pierce the jacket of the cable positioned within the plug body to contact the first and second electrical wires of the cable respectively, establishing an electrical path from the first and second wires of the cable through the first electrical contact and the second electrical contact to the socket.

In another general aspect, the present disclosure is directed to an assembly that comprises the plug body, the housing, and the end cap.

In various implementations, the cable comprises a heat trace cable. Also, each of the first blade and the second blade can be V-shaped. Still further, a notch may be disposed along a peripheral edge of the end cap and a tab may extend from the housing, such that the tab engages the notch when the end cap is engaged with the housing such that the end cap is secured in place on the housing. The tap may be spring-biased tab such that the end cap is disengageable from the housing by depressing the spring-biased tab. The kit and/or assembly may further comprise an extender attachable to the housing. Also, the end cap, plug body, and housing are preferably watertight when engaged together.

In another general aspect, the present disclosure is directed to a method that comprises the steps of staging an end cap onto the connection end of the cable, cutting the outer jacket of the cable and retracting the outer jacket to expose the inner jacket, inserting the connection end of the cable into a plug body, and threadably engaging an end cap sized to receive the plug body with a housing, the housing comprising a socket to receive the first electrical contact and the second electrical contact, such that engaging the end cap with the housing causes the first member and the second member to contact the housing and pivot inwardly such that the first blade and the second blade pierce the inner jacket of the cable positioned within the plug body to contact the first and second electrical wires of the cable respectively, establishing an electrical path from the first and second wires of the cable through the first electrical contact and the second electrical contact to the socket.

The housing, plug body, and various other components of the cable connector assembly can be constructed from a substantially nonconductive material, e.g., polycarbonate or silicon rubber. The substantially nonconductive material can be the same material or different materials having nonconductive properties for each of these components. The components of the cable connector assembly configured to transmit electrical energy, e.g., the conductive members including the blades and pins, can be constructed from a conductive material, e.g., stainless steel. The conductive material can be the same material or different materials having conductive properties for each of these components. The various components of the cable connector assembly can be constructed utilizing a variety of different means or methods, including injection molding, fastening, welding, and soldering.

In various embodiments disclosed herein, a single component may be replaced by multiple components and multiple components may be replaced by a single component to perform a given function or functions. Except where such substitution would not be operative, such substitution is within the intended scope of the embodiments.

While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

What is claimed is:

1. A kit comprising:

a plug body comprising:

an opening sized to receive a cable, the cable comprising first and second electrical wires and a jacket surrounding the first and second electrical wires;

a first member pivotably connected to the plug at a first position, the first member comprising:

a first blade extending inwardly relative to the plug body; and a first electrical contact; and a second member pivotably connected to the plug at a second position, the second member comprising:

a second blade extending inwardly relative to the plug body; and a second electrical contact;

wherein the second position is longitudinally offset from the first position;

a housing comprising a socket to receive the first electrical contact and the second electrical contact; and an end cap threadably engageable with the housing, the end cap comprising an interior sized to receive the plug body;

wherein engaging the end cap with the housing causes the first member and the second member to contact the housing and pivot inwardly such that the first blade and the second blade pierce the jacket of the cable positioned within the plug body to contact the first and second electrical wires of the cable respectively, establishing an electrical path from the first and second wires of the cable through the first electrical contact and the second electrical contact to the socket.

2. The kit of claim 1, wherein the socket is a first socket and the end cap is a first end cap, the kit further comprising:

a power plug assembly comprising:

an electrical conduit; and a power plug electrical contact in electrical communication with the electrical conduit;

a second end cap threadably engageable with the housing, the second end cap comprising an interior sized to receive the power plug assembly; and the housing comprising a second socket to receive the power plug electrical contact, the second socket in electrical communication with the first socket;

wherein engaging the second end cap with the housing establishes the electrical path from the electrical conduit through the first socket and the second socket to the first and second wires of the cable.

3. The kit of claim 1, wherein the cable comprises a heat trace cable.

4. The kit of claim 1, wherein each of the first blade and the second blade are V-shaped.

5. The kit of claim 1, further comprising:

a notch disposed along a peripheral edge of the end cap; and a tab extending from the housing;

wherein the tab engages the notch when the end cap is engaged with the housing such that the end cap is secured in place on the housing.

6. The kit of claim 5, wherein the tab comprises a spring-biased tab, the end cap is disengageable from the housing by depressing the spring-biased tab.

7. The kit of claim 1, further comprising an extender attachable to the housing.

8. The kit of claim 1, wherein the end cap, plug body, and housing are watertight when engaged together.

9. An assembly comprising:

a plug body comprising:

an opening sized to receive a cable, the cable comprising first and second electrical wires and a jacket surrounding the first and second electrical wires;

a first member pivotably connected to the plug at a first position, the first member comprising:

a first blade extending inwardly relative to the plug body; and a first electrical contact; and a second member pivotably connected to the plug at a second position, the second member comprising:

a second blade extending inwardly relative to the plug body; and a second electrical contact;

wherein the second position is longitudinally offset from the first position;

a housing comprising a socket to receive the first electrical contact and the second electrical contact; and an end cap comprising an interior sized to receive the plug body, the end cap threadably engaged with the housing such that the housing causes the first member and the second member to pivot inwardly such that the first blade and the second blade pierce the jacket of the cable positioned within the plug body and contact the first and second electrical wires of the cable respectively, establishing an electrical path from the first and second wires of the cable through the first electrical contact and the second electrical contact to the socket.

10. The kit of claim 9, wherein the socket is a first socket and the end cap is a first end cap, the kit further comprising:

a power plug assembly comprising:

an electrical conduit; and a power plug electrical contact in electrical communication with the electrical conduit;

a second end cap threadably engaged with the housing, the second end cap comprising an interior sized to receive the power plug assembly; and the housing comprising a second socket to receive the power plug electrical contact, the second socket in electrical communication with the first socket;

wherein engaging the second end cap with the housing establishes the electrical path from the electrical conduit through the first socket and the second socket to the first and second electrical wires of the cable.

11. The kit of claim 9, wherein the cable comprises a heat trace cable.

12. The kit of claim 9, wherein each of the first blade and the second blade are V-shaped.

13. The kit of claim 9, further comprising:

a notch disposed along a peripheral edge of the end cap; and a tab extending from the housing;

wherein the tab engages the notch such that the end cap is secured in place on the housing.

14. The kit of claim 13, wherein the tab comprises a spring-biased tab, the end cap is disengageable from the housing by depressing the spring-biased tab.

15. The kit of claim 9, further comprising an extender attached to the housing.

16. The kit of claim 9, wherein the end cap, plug body, and housing are watertight.

17. A method of terminating a cable comprising a connection end, first and second electrical wires, an outer jacket, and an inner jacket surrounding the first and second electrical wires, the method comprising:

staging an end cap onto the connection end of the cable;

cutting the outer jacket of the cable and retracting the outer jacket to expose the inner jacket;

inserting the connection end of the cable into a plug body, the plug body comprising:

an opening sized to receive the cable;

a first member pivotably connected to the plug at a first position, the first member comprising:

a first blade extending inwardly relative to the plug body; and a first electrical contact; and a second member pivotably connected to the plug at a second position, the second member comprising:

a second blade extending inwardly relative to the plug body; and a second electrical contact; and threadably engaging an end cap sized to receive the plug body with a housing, the housing comprising a socket to receive the first electrical contact and the second electrical contact;

wherein engaging the end cap with the housing causes the first member and the second member to contact the housing and pivot inwardly such that the first blade and the second blade pierce the inner jacket of the cable positioned within the plug body to contact the first and second electrical wires of the cable respectively, establishing an electrical path from the first and second wires of the cable through the first electrical contact and the second electrical contact to the socket.

18. The method of claim 17, further comprising attaching a thimble over the retracted outer jacket.

19. The method of claim 17, further comprising:

attaching an extender to the housing; and securing the extender to a support surface.

20. The method of claim 17, wherein the socket is a first socket and the end cap is a first end cap, the method further comprising:

inserting a power plug assembly with the housing, the power plug assembly comprising:

an electrical conduit; and a power plug electrical contact in electrical communication with the electrical conduit; and threadably engaging a second end cap, the second end cap comprising an interior sized to receive the power plug assembly;

wherein engaging the second end cap with the housing causes the power plug electrical contact to be received by a second socket in electrical communication with the first socket, establishing the electrical path from the electrical conduit through the first socket and the second socket to the first and second wires of the cable.

* * * * *